US009222220B2

(12) United States Patent
Sjöström et al.

(10) Patent No.: US 9,222,220 B2
(45) Date of Patent: Dec. 29, 2015

(54) REFINER AND BLADE ELEMENT

(75) Inventors: Håkan Sjöström, Helsinki (FI); Kati Lindroos, Helsinki (FI); Matti Kaarineva, Helsinki (FI); Tomi Iisakkila, Helsinki (FI)

(73) Assignee: VALMET TECHNOLOGIES, INC., Espoo (FI)

( * ) Notice: Subject to any disclaimer, the term of this patent is extended or adjusted under 35 U.S.C. 154(b) by 150 days.

(21) Appl. No.: 13/981,793

(22) PCT Filed: Jan. 26, 2012

(86) PCT No.: PCT/FI2012/050074

§ 371 (c)(1),
(2), (4) Date: Jul. 25, 2013

(87) PCT Pub. No.: WO2012/101331

PCT Pub. Date: Aug. 2, 2012

(65) Prior Publication Data

US 2013/0306769 A1 Nov. 21, 2013

(30) Foreign Application Priority Data

Jan. 27, 2011 (FI) ..... 20115082

(51) Int. Cl.
*B02C 7/12* (2006.01)
*D21D 1/30* (2006.01)
*D21D 1/22* (2006.01)

(52) U.S. Cl.
CPC *D21D 1/306* (2013.01); *B02C 7/12* (2013.01); *D21D 1/22* (2013.01); *D21D 1/30* (2013.01); *D21D 1/303* (2013.01)

(58) Field of Classification Search
CPC ..... B02C 7/12; D21D 1/303; D21D 1/30; D21D 1/306
USPC ..... 241/261.2, 261.3, 296, 298, 84, 86, 241/89.3
See application file for complete search history.

(56) References Cited

U.S. PATENT DOCUMENTS 5,476,228 A 12/1995 Underberg
8,646,708 B2 2/2014 Halla (Continued)

FOREIGN PATENT DOCUMENTS

DE 102008039003 A1 2/2010
GB 1556925 12/1979

(Continued)

OTHER PUBLICATIONS

International Search Report for PCT/FI2012/050074 dated May 11, 2012.

(Continued)

*Primary Examiner* — Faye Francis
(74) *Attorney, Agent, or Firm* — Stiennon & Stiennon

(57) ABSTRACT

A refiner comprises at least one first refining surface (1') and at least one second refining surface (2'), which refining surfaces (1', 2') are arranged opposite to one another and mobile in relation to one another. In the refiner (10, 11) either at least the first (1') or the second (2') refining surface comprises refining surface portions (15, 27) feeding material to be refined and/or refining surface portions (15, 27) discharging refined material as well as refining surface portions (16) grinding the material to be refined, on the upper surface of which there are blade bars (17) and between them blade grooves (18). Both in the first refining surface (1') and in the second refining surface (2') of the refiner (10, 11) the cross-sectional area (A) of at least some blade grooves (18) are arranged to change in the longitudinal direction of the blade grooves (18).

18 Claims, 9 Drawing Sheets

(56) References Cited

U.S. PATENT DOCUMENTS

| | | | | |
|---|---|---|---|---|
| 2007/0084952 | A1* | 4/2007 | Sjostrom et al. | 241/261.2 |
| 2008/0302897 | A1* | 12/2008 | Sjostrom et al. | 241/298 |

FOREIGN PATENT DOCUMENTS

| | | | |
|---|---|---|---|
| WO | 2005032720 | A1 | 4/2005 |
| WO | 2005032721 | A1 | 4/2005 |
| WO | 2007065971 | A1 | 6/2007 |
| WO | 2009153413 | A1 | 12/2009 |
| WO | 2010112667 | A1 | 10/2010 |
| WO | 2012101330 | A1 | 8/2012 |
| WO | 2012101331 | A1 | 8/2012 |

OTHER PUBLICATIONS

Written Opinion of the International Searching Authority for PCT/FI2012/050074 dated May 11, 2012.

Applicant's comments (dated Nov. 19, 2012) regarding the Written Opinion of the International Searching Authority for PCT/FI2012/050074 dated May 11, 2012 and mailed May 15, 2012.

Written Opinion of the International Preliminary Examining Authority for PCT/FI2012/050074 mailed on Jan. 22, 2013.

International Preliminary Report on Patentability dated Apr. 4, 2013.

* cited by examiner

A-A

REFINER AND BLADE ELEMENT

CROSS REFERENCES TO RELATED APPLICATIONS

This application is a U.S. national stage application of International App. No. PCT/FI2012/050074, filed Jan. 26, 2012, the disclosure of which is incorporated by reference herein and claims priority on Finnish Application No. 20115082, filed Jan. 27, 2011, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to refiners intended for refining fibrous material, and to blade elements to be used therein.

Refiners intended for refining fibrous, lignocellulose-containing material are employed, for instance, for producing pulp to be used in paper or board making. Conventionally, these refiners comprise two refining surfaces opposite one another, at least one refining surface of which is arranged mobile or rotating in such a manner that the refining surfaces may move in relation to one another. One refiner, however, may also comprise several pairs of refining surfaces arranged opposite to one another. Between the opposing refining surfaces there is a blade gap, into which the material to be refined is fed.

WO publication 2005/032720 A1 discloses a refining surface comprising protrusion-like refining surface portions which grind the material to be refined and which are placed between groove-like refining surface portions feeding material to be refined in a blade gap and discharging refined material from the blade gap. Said refining surface portions feeding material to be refined and discharging refined material contribute to the passage of refined material in the blade gap of the refiner. The upper surface of the refining surface portions defibrating the material to be refined comprises blade bars, which perform the actual refining, and between them blade grooves, which connect said groove-like refining surface portions feeding the material to be refined and discharging the refined material. The solution disclosed in said publication provides a refining surface of large refining surface area.

SUMMARY OF THE INVENTION

The object of this invention is to provide a novel refiner and a blade element for further enhancing the refining of fibrous material.

The refiner of the invention for refining fibrous material comprises at least one first refining surface and at least one second refining surface, which refining surfaces are arranged opposite to one another and mobile in relation to one another, said refiner having, at least on the first or the second refining surface, refining surface portions feeding the material to be refined and/or refining surface portions discharging the refined material as well as refining surface portions grinding the material to be refined, the upper surface of which portions comprises blade bars and between them blade grooves, and at least on both the first refining surface and the second refining surface of said refiner the cross-sectional area of at least some blade grooves is arranged to change in the longitudinal direction of the blade grooves and at least on one refining surface of which refiner the blade bars and the blade grooves are arranged at a blade angle of 40 to 80 degrees.

A blade element for a refiner intended for refining fibrous material comprises a refining surface with refining surface portions grinding material to be refined, the upper surface of which portions comprises blade bars and between them blade grooves, and in which blade element the cross sectional area of at least some blade grooves is arranged to change in the longitudinal direction of the blade grooves and the blade bars and the blade grooves are arranged at a blade angle of 40 to 80 degrees.

Thus, the refiner for refining fibrous material comprises at least one first refining surface and at least one second refining surface, which refining surfaces are arranged opposite to one another and mobile in relation to one another. At least the first or the second refining surface of the refiner includes refining surface portions feeding material to be refined and/or refining surface portions discharging refined material as well as refining surface portions grinding the material to be refined, the upper surface of which portions comprises blade bars and between them blade grooves. Further, both in the first refining surface and in the second refining surface of the refiner the cross-sectional area of at least some blade grooves is arranged to change in the longitudinal direction of the blade grooves and in at least one refining surface the blade bars and the blade grooves are arranged at a blade angle of 40 to 80 degrees.

With the refiner concerned, in the opposing refining surfaces of which, on the upper surface of the grinding refining surface portions, there are blade grooves whose cross-sectional area is arranged to change in the run direction or longitudinal direction of the blade grooves, it is easy to affect how the material to be refined is transferred between the opposing refining surfaces, i.e. how often the material to be refined is transferred to the blade gap between the opposing refining surfaces and/or how large a portion of the material to be refined is transferred into the blade gap between the opposing refining surfaces, whereby the fibre length, refining grade and/or homogeneity of the refined material may be affected efficiently. The change in the cross sectional area of the blade groove may be implemented by changing the depth and/or width of the blade groove. In addition, when in at least one refining surface the blade bars and the blade grooves are arranged at the blade angle of 40 to 80 degrees, it is also simultaneously possible to affect how fast the material to be refined proceeds onwards on the refining surfaces of the refiner.

According to an embodiment, the width of the blade bars in the refining surfaces is 0.5 to 5 mm and the width of the blade grooves is 0.5 to 5 mm.

According to a second embodiment, at least a first refining surface of the refiner is arranged rotatable and in the first refining surface the depth of the blade groove is arranged to increase and in the second refining surface the depth of the blade groove is arranged to decrease in the direction of rotation of the first refining surface.

According to a third embodiment, at least a first refining surface of the refiner is arranged rotatable and both in the first refining surface and the second refining surface the depth of the blade groove is arranged to increase in the direction of rotation of the first refining surface.

BRIEF DESCRIPTION OF THE DRAWINGS

Some embodiments of the invention are described in greater detail in the accompanying drawings.

For the sake of clarity, the figures show some embodiments of the invention in a simplified manner. In the figures, like reference numerals identify like elements.

DESCRIPTION OF THE PREFERRED EMBODIMENTS

Figure 1:
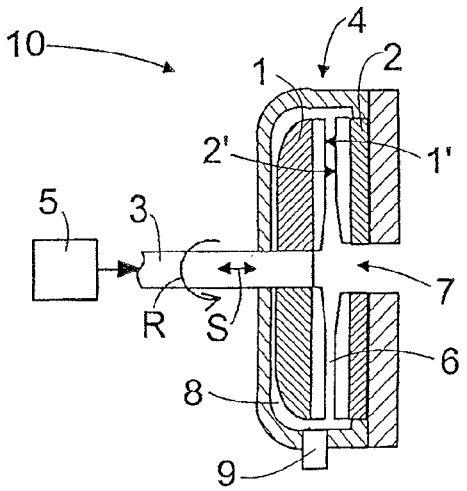
FIG. 1 schematically shows a side view of a general structure of a disc refiner in cross-section.

FIG. 1 schematically shows a cross-sectional side view of a disc refiner 10. The disc refiner 10 of FIG. 1 comprises a disc-like first refining element 1 and a disc-like second refining element 2. The first refining element 1 includes a first refining surface 1' and the second refining element 2 includes a second refining surface 2'. The first refining element 1 and the second refining element 2 are arranged coaxially to one another such that the first refining surface 1' and the second refining surface 2' will be substantially opposite to one another. In the disc refiner 10 of FIG. 1 the first refining element 1 is arranged rotatable by a shaft 3, for instance, in the direction of arrow R shown schematically in FIG. 1, the first refining element 1 thus constituting a rotor 1 of the disc refiner 10. For the sake of clarity, FIG. 1 does not show the motor used for rotating the first refining element 1, which motor may be implemented in manners obvious to a person skilled in the art. Further, in the disc refiner 10 of FIG. 1 the second refining element 2 is fixedly supported to a frame structure 4 of the disc refiner 10, the second refining element 2 thus constituting a stator 2 of the refiner 10. Thus, as the first refining element 1 rotates, when the refiner 10 is in operation, the first refining surface 1' and the second refining surface 2' are arranged to move in relation to one another. FIG. 1 further shows a loading device 5, which is coupled to act through a shaft 3 on the first refining element 1 such that the first refining element 1 may be transferred towards the second refining element 2 or away therefrom, as schematically indicated by arrow S, so as to adjust a gap 6 between the first refining element 1 and the second refining element 2, i.e. the blade gap 6.

In the disc refiner 10 of FIG. 1, fibrous, lignocellulose-containing material to be defibrated or refined may be fed through an opening 7 in the middle of the second refining element 2 into a blade gap 6 between the refining surfaces 1' and 2', where it is defibrated and refined while the water contained in the material vaporizes. The material to be defibrated may also be fed into the blade gap 6 through openings in the first refining surface 1' and/or the second refining surface 2', which openings are not shown in FIG. 1 for the sake of clarity. Defibrated material exits the blade gap 6 from its outer edge to a refining chamber 8 of the refiner 10 and further out of the refining chamber 8 through a discharge channel 9.

Figure 2:
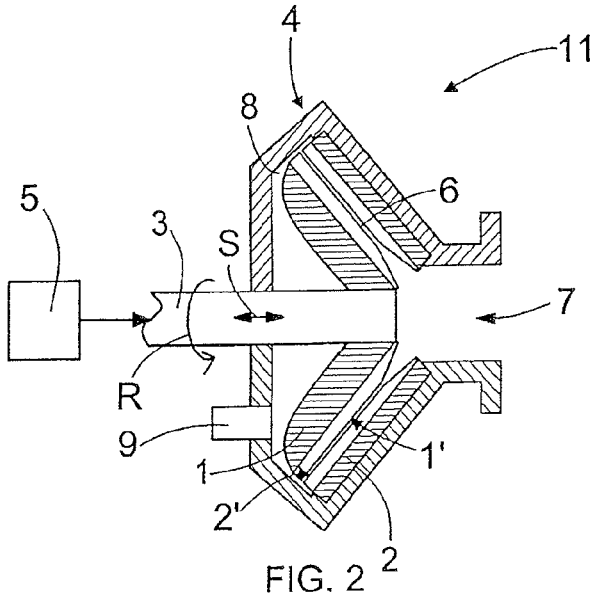
FIG. 2 schematically shows a side view of a general structure of a cone refiner in cross-section.

FIG. 2 schematically shows a cross-sectional side view of a cone refiner 11. The cone refiner 11 of FIG. 2 comprises a conical first refining element 1 and a conical second refining element 2. The first refining element 1 includes a first refining surface 1' and the second refining element 2 includes a second refining surface 2'. The first refining element 1 and the second refining element 2 are arranged coaxially to one another such that the first refining surface 1' and the second refining surface 2' will be substantially opposite to one another. In the cone refiner 11 of FIG. 2 the first refining element 1 is arranged rotatable by a shaft 3, for instance, in the direction of arrow R shown schematically in FIG. 2, the first refining element 1 thus constituting a rotor 1 of the cone refiner 11. For the sake of clarity, FIG. 2 does not show the motor used for rotating the first refining element 1, which motor may be implemented in manners obvious to a person skilled in the art. Further, in the cone refiner 11 of FIG. 2 the second refining element 2 is fixedly supported to a frame structure 4 of the cone refiner 11, the second refining element 2 thus constituting a stator 2 of the refiner 11. Thus, as the first refining element 1 rotates, when the refiner 11 is in operation, the first refining surface 1' and the second refining surface 2' are arranged to move in relation to one another. FIG. 2 further shows a loading device 5, which is coupled to act through a shaft 3 on the first refining element 1 such that the first refining element 1 may be transferred towards the second refining element 2 or away therefrom, as schematically indicated by arrow S, so as to adjust a gap 6 between the first refining element 1 and the second refining element 2, i.e. the blade gap 6.

In the cone refiner 11 of FIG. 2, fibrous, lignocellulose-containing material to be defibrated or refined may be fed through an opening 7 in the middle of the second refining element 2 into a blade gap 6 between the refining surfaces 1' and 2', where it is defibrated and refined while the water contained in the material vaporizes. The material to be defibrated may also be fed into the blade gap 6 through openings in the first refining surface 1' and/or the second refining surface 2', which openings are not shown in FIG. 2 for the sake of clarity. Defibrated material exits the blade gap 6 from its outer edge to a refining chamber 8 of the refiner 11 and further out of the refining chamber 8 through a discharge channel 9.

In addition to the disc refiner 10 of FIG. 1 and the cone refiner 11 of FIG. 2, it is also possible to employ cylindrical refiners for refining fibrous material, the cylindrical refiners having a cylindrical first refining surface 1' and a cylindrical second refining surface 2'. The disc refiner 10 of FIG. 1 and the cone refiner 11 of FIG. 2 are shown to have just one mobile refining surface and one fixed refining surface, but such embodiments of disc, cone and cylindrical refiners that have more than one pair of a fixed refining surface and a refining surface mobile in relation thereto are also possible. Further, it is also possible to have embodiments of disc, cone and cylindrical refiners that only comprise mobile or rotatable refining surfaces. Various refiners as well as structural and operating principles thereof are known per se to a person skilled in the art and therefore they are not discussed here in any greater detail.

The refining surface may be provided in the refining element in a variety of ways. The refining surface may be provided directly in the refining element in, such a way that the refining surface is one piece or of uniform material with the refining element. Thus, at the same time the refining element also constitutes the blade element of the refiner. Typically, the refining surface of the refining element is provided, however, by attaching one or more detachable blade elements to the refining element. In that case one single blade element may constitute the entire refining surface of the refining element, i.e. the whole refining surface of the refining element is formed by one single blade element. Alternatively, it is possible to attach a plurality of adjacently positioned blade elements to the surface of the refining element, whereby the whole refining surface of the refining element consists of a plurality of adjacently placed blade elements, and consequently said blade elements are often referred to as blade segments.

Figure 3:
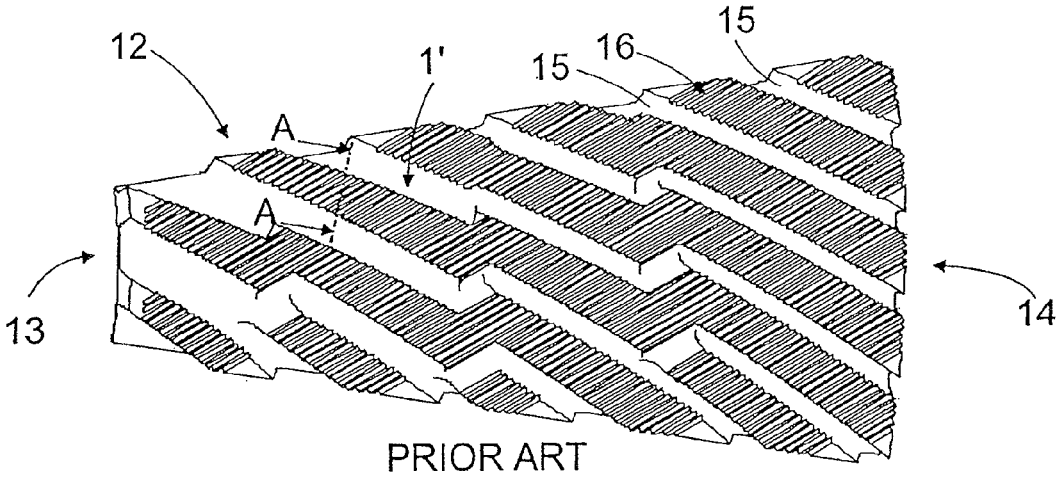
PRIOR ART FIG. 3
FIG. 3 schematically shows a prior art blade element seen in the direction of a refining surface of the blade element.
Figure 4:
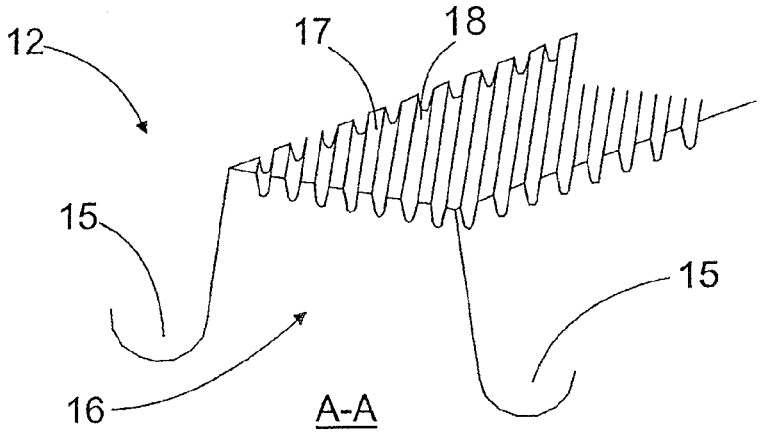
PRIOR ART FIG. 4
FIG. 4 schematically shows an end view of part of the blade element of FIG. 3.

FIG. 3 shows schematically a prior art blade element 12 seen in the direction of the refining surface of the blade element 12, and FIG. 4 is a schematic end view of part of the blade element 12 of FIG. 3. The blade element 12 of FIG. 3 may be used for providing part of the refining surface of the cone refiner rotor, and therefore the refining surface in FIG. 3 is denoted by reference numeral 1'.

The blade element 12 of FIGS. 3 and 4 comprises a feed edge 13 directed towards the feed of material to be refined, via which feed edge the material to be refined is transferred to a blade gap of the refiner, and the blade element 12 comprises a discharge edge 14 directed towards the discharge of refined material, via which discharge edge the refined material exits the blade gap of the refiner. The blade element 12 further comprises first refining surface portions 15 in the form of a recess or a groove, which are arranged to convey fibrous material on the refining surface 1' from the direction of the feed edge 13 of the refining surface 1' to the direction of the discharge edge 14 of the refining surface 1', i.e. the first refining surface portions 15 are arranged to feed material to be refined onto the refining surface 1' and to discharge refined material from the refining surface F. Between the first refining surface portions 15 there are protrusion-like second refining surface portions 16, which grind the material to be refined and on the upper surface of which there are blade bars 17 and between them blade grooves 18, which constitute the refining elements of the blade element 12. The blade grooves 18 are arranged to connect the feeding and/or discharging first refining surface portions 15 that convey the fibrous material. The purpose of the blade grooves 18 is to transfer the fibrous material passing on the first refining surface portions 15 between the blade bars 17 of the opposing refining surfaces of the refiner so as to defibrate and refine the fibrous material.

Figure 5A:
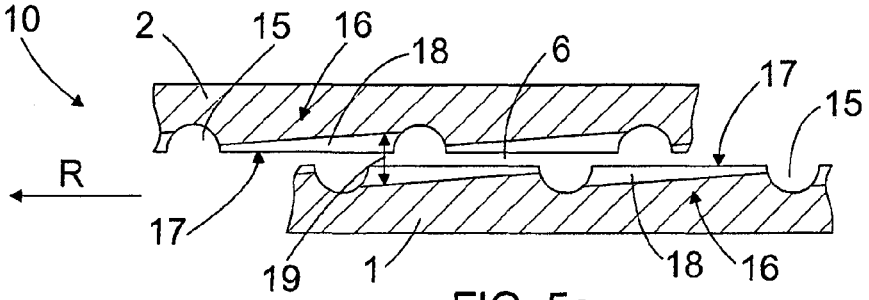
FIGS. 5*a*, 5*b* and 5*c* show schematically in cross section a disc refiner and its operation as refining elements of the refiner rotate in relation to one another.
Figure 5B:
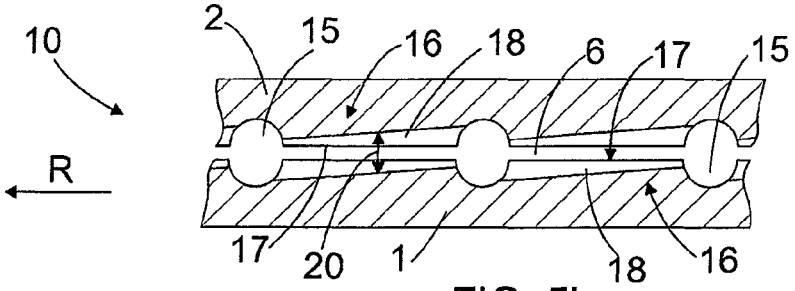
Figure 5C:
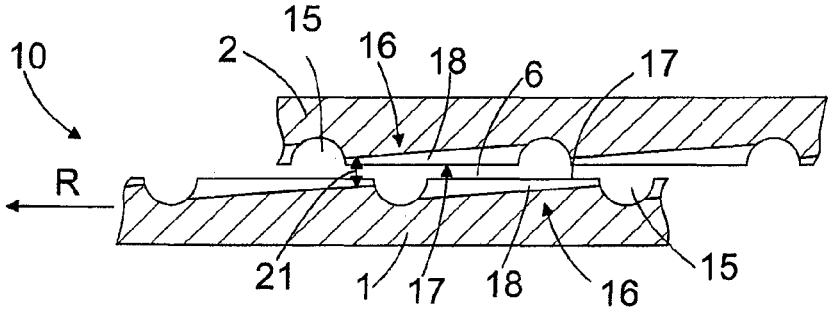

FIGS. 5*a*, 5*b* and 5*c* show in schematic cross section a rotor 1 and a stator 2 of a disc refiner 10 in mutually different phases of a refining surface 1' of the rotor 1 and of a refining surface 2' of the stator 2 as the rotor 1 rotates in the direction indicated by arrow R. The rotor 1 comprises groove-like first refining surface portions 15 and between them protrusion-like second refining surface portions 16, on the upper surface of which there are blade bars 17 and between them blade grooves 18, which constitute the refining surface 1' of the rotor 1. The stator 2 also comprises groove-like first refining surface portions 15 and between them protrusion-like second refining surface portions 16, on the upper surface of which there are blade bars 17 and between them blade grooves 18, which constitute the refining surface 2' of the stator 2. In the refiner of FIGS. 5*a*, 5*b* and 5*c* the depth of both the blade grooves 18 of the rotor 1 and the blade grooves 18 of the stator 2 is arranged to change in the longitudinal direction, i.e. run direction of the blade grooves 18 such that in the rotor 1 the depth of the blade groove 18 is arranged to increase in the same direction with the rotating direction R of the rotor 1, i.e. to decrease in the opposite direction to the rotating direction R of the rotor 1, whereas in the stator 2 the depth of the blade groove 18 is arranged to decrease in the same direction with the rotating direction R of the rotor 1, i.e. to increase in the opposite direction to the rotating direction R of the rotor 1. In the blade grooves 18 the travel direction of the material to be refined is substantially the same with the rotating direction of the rotor 1.

In FIG. 5*a* the rotor 1 and the stator 2 are shown substantially in an operating situation, where the blade groove 18 of the rotor 1 and the blade groove 18 of the stator 2 encountering one another have the volumes at their largest. Thus, between the refining surfaces there is formed an area having a large volume, which is indicated schematically by reference numeral 19 in FIG. 5*a*. In said situation the groove volume between the refining surfaces 1' and 2' is at largest and the material to be refined is transferred both on the refining surface 1' of the rotor 1 and on the refining surface 2' of the stator 2 from the first refining surface portions 15 into the blade grooves 18.

In FIG. 5*b* the rotor 1 and the stator 2 are shown substantially in an operating situation, where the volumes of the blade groove 18 of the rotor 1 and the blade groove 18 of the stator 2 encountering one another are decreasing. Thus, between the refining surfaces there is formed an area having a decreasing volume, which is indicated schematically by reference numeral 20 in FIG. 5*b*. In said situation the groove volume between the refining surfaces 1' and 2' is decreasing and the material to be refined is transferred both from the blade grooves 18 of the rotor 1 and from the blade grooves 18 of the stator 2 into the blade gap 6 between the refining surfaces 1' and 2'.

In FIG. 5*c* the rotor 1 and the stator 2 are shown substantially in an operating situation, where the blade groove 18 of the rotor 1 and the blade groove 18 of the stator 2 encountering one another have the volumes at their smallest. Thus, between the refining surfaces there is formed an area having a small volume, which is indicated schematically by reference numeral 21 in FIG. 5*c*. In said situation the groove volume between the refining surfaces 1' and 2' is at the minimum and the material to be refined is transferred highly effectively both from the blade grooves 18 of the rotor 1 and from the blade grooves 18 of the stator 2 into the blade gap 6 between the refining surfaces 1' and 2' for being refined.

As the groove volume of the refining surfaces of the refiner decreases in the blade grooves 18 in the travel direction of the material to be refined, i.e. substantially in the rotating direction of the rotor 1 simultaneously both on the refining surface 1' of the rotor 1 and on the refining surface 2' of the stator 2, such decrease in the groove volume efficiently conveys the material to be refined into the blade gap 6 for grinding, while the rotor 1 rotates, as a result of which refining effect is exerted on a larger portion of fibers than before. At the same time the material to be refined forms a material layer between the refining surfaces 1' and 2', which effectively prevents a mutual blade contact of the opposing refining surfaces, which might, damage the refining surfaces.

Figure 6:
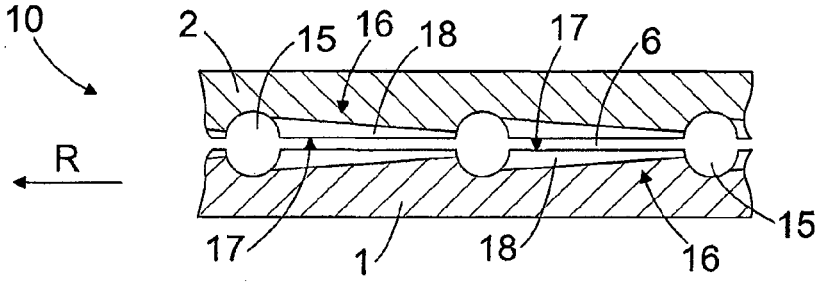
FIG. 6 schematically shows a second disc refiner in cross-section.

FIG. 6 shows in schematic cross section a rotor 1 and a stator 2 of a second disc refiner 10. In the refiner of FIG. 6 the depth of both the blade grooves 18 of the rotor 1 and the blade grooves 18 of the stator 2 is arranged to change in the longitudinal direction, i.e. run direction of the blade grooves 18 such that both in the rotor 1 and in the stator 2 the depth of the blade groove 18 is arranged to increase in the same direction with the rotating direction R of the rotor 1, i.e. in the travel direction of the material to be refined in the blade grooves 18. When the groove volume of the refiner increases in the travel direction of the material to be refined at the same time on the refining surfaces of both the rotor 1 and the stator 2, this enlargement in groove volume makes the pressure in the blade groove become lower than the pressure prevailing in the blade gap 6 as the rotor 1 rotates. This decreases axial loading of refining, as a result of which the blade gap of the refiner 1 becomes smaller, which enhances both the refining effect on the material to be refined and transfer of the material to be refined from the direction of the blade gap to the blade grooves, whereby only part of the fibers are exposed to more powerful refining effect.

Figure 7:
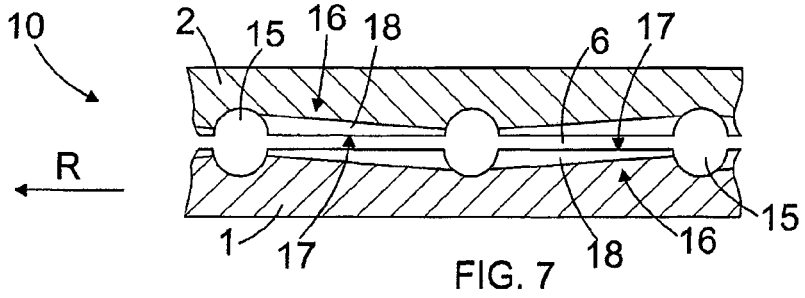
FIG. 7 schematically shows a third disc refiner in cross-section.

FIG. 7 shows in schematic cross section a rotor 1 and a stator 2 of a third disc refiner 10. In the refiner of FIG. 7, the depth of both the blade grooves 18 of the rotor 1 and the blade grooves 18 of the stator 2 is arranged to change in the longitudinal direction, i.e. run direction, of the blade grooves 18 such that both in the rotor 1 and in the stator 2 the depth of the blade groove 18, seen in the rotating direction R of the rotor 1, is arranged to decrease in every other second refining surface portion 16 and to increase in every other second refining surface portion 16, i.e. in the refiner 10 of FIG. 7, as the depth of the blade groove 18 of the rotor 1 increases, in other words, as the volume of the blade groove 18 of the rotor 1 increases, the depth of the blade groove 18 of the stator 2 decreases, in other words the volume of the blade groove 18 of the stator 2 decreases, or vice versa. As the volume of the blade groove, i.e. the groove volume, decreases in relation to the refining surface in the travel direction of material to be refined on one refining surface and simultaneously increases on the opposing refining surface, this change in groove volume induces material flow from the refining surface of decreasing groove volume through the blade gap 6 to the refining surface of increasing groove volume or towards it, when the rotor 1 rotates. The alternately decreasing and increasing groove volume arranged in the opposing refining surfaces provides continuous movement in the material to be refined from one refining surface to another through the blade gap 6, and consequently the material is exposed to efficient refining treatment.

Figure 16:
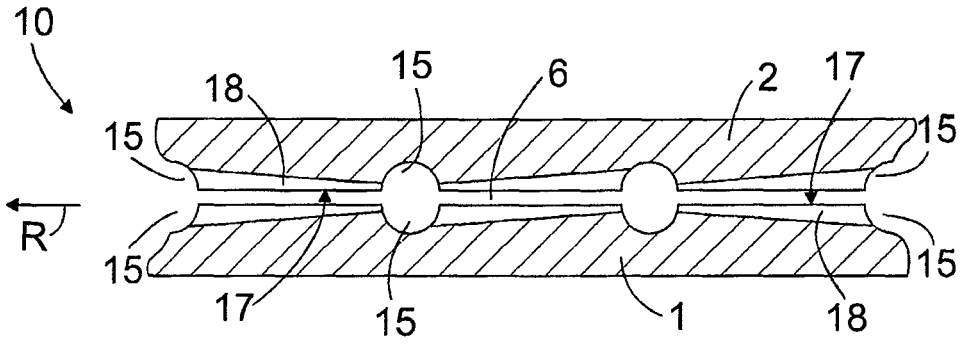
FIG. 16 schematically shows a fourth disc refiner in cross-section.

FIG. 16 schematically shows a fourth disc refiner 10 in cross-section. In the refiner of FIG. 16, the depth of the blade grooves 18 of the rotor 1 is arranged to change in the longitudinal direction, i.e. run direction, of the blade grooves 18 such that in two successive refining surface portions 16 the depth of the blade groove 18 is arranged to increase and in the subsequent refining surface portion 16 to decrease, when the rotor 1 is seen in the circumferential direction thereof and the depth of the blade groove 18 is seen in the rotating direction of the rotor 1. Seen in the circumferential direction of the rotor 1, the depth of the blade groove 18 in two successive refining surface portions 16 is thus arranged to increase and in the subsequent refining surface portion 16 to decrease, which alternation is repeated in the circumferential direction of the rotor 1. Thus, while rotating the rotor 1 directs the material to be refined in the rotating direction R of the rotor 1, whereby a speed component, parallel to the rotating direction R of the rotor 1, lower than the speed of the rotor 1 and higher than the speed of the stationary stator 2 is provided in the material to be refined, in other words, the material to be refined lags behind the rotor 1 for a relative speed difference between the rotor 1 and the material to be refined. In that case the material to be refined is directed in two successive refining surface portions 16 in the direction of the blade gap 6, i.e. from the blade grooves 18 of the rotor 1 towards the blade grooves 18 of the stator 2 as the groove volume of the refining surface 1' of the refiner 1 decreases, and correspondingly, in one refining surface portion 16 subsequent to said refining surface portions 16 in the opposite direction, in other words, from the grooves 18 of the stator 2 towards the blade grooves 18 of the rotor 1 as the groove volume of the refining surface 1' of the rotor 1 increases in the refining surface portion concerned of the rotor 1.

In the solution of FIG. 16, the stator 2 uses the same kind of refining element as the rotor 1, whereby the depth of the blade grooves 18 in two successive refining surface portions 16 of the refining surface 2' of the stator 2 is arranged to decrease, seen in the rotating direction R of the rotor 1, and to increase in one refining surface portion 16 subsequent thereto. In that case the material to be refined, while moving in the rotating direction R of the rotor 1 in the blade grooves of the two first-mentioned refining surface portions 16 in the refining surface 2' of the stator 2, is directed, as the depth of the blade grooves 18 decreases, into the blade gap 6, i.e. from the blade grooves 18 of the stator 2 towards the blade grooves of the rotor 1 and, in one refining surface portion 16 subsequent thereto, from the direction of the blade grooves 18 of the rotor 1 towards the blade grooves 18 of the stator 2. In this embodiment, within the area of two successive refining surface portions 16 there is produced between the refining surface 2' of the stator 2 and the refining surface 1' of the rotor 1 a pressing effect, i.e. refining effect that raises the pressure between the refining surfaces, and within one refining surface area 16 a sucking effect, i.e. refining effect that lowers the pressure between the refining surfaces.

A possible refiner embodiment is also one having in the refining surface 2' of the stator 2 only blade grooves 18 decreasing in depth in the rotating direction R of the rotor 1 and in the refining surface 1' of the rotor 1 mostly blade grooves 18 increasing in depth in the same direction with the rotating direction R of the rotor 1, but also to some extent such blade grooves 18 that decrease in depth in the same direction with the rotating direction of the rotor 1. Thus, between the refining surfaces there is produced mainly a compressive refining effect, and at regular intervals there is also provided an efficient control effect for enhancing the material flow from the direction of the refining surface of the stator to the direction of the refining surface of the rotor, which has a cleaning effect on the refining surfaces and a resulting enhancing effect on refining.

FIGS. 5*a*, 5*b*, 5*c*, 6, 7 and 16 show a refiner blade element and a refiner, in which the depth of the blade groove 18 in the refining surface, in other words the volume of the blade groove 18, is arranged to change in the longitudinal direction, or run direction, of the blade groove 18, in other words, when the blade groove 18 runs in the second refining surface portion 16, the blade groove 18 simultaneously connects two adjacent first refining surface portions 15. The depth or volume of the blade groove 18 may be arranged to change in every blade groove 18 or only in some blade grooves, whereby the blade grooves 18 are arranged to change both in the refining surface of the rotor 1 and in the refining surface of the stator 2 such that when the refiner is in operation those blade grooves 18, both in the refining surface of the rotor 1 and in the refining surface of the stator 2, whose depth is arranged to change in the longitudinal direction of the blade groove 18, meet one another as the rotor 1 rotates in relation to the stator 2. It is also possible that different variations shown in FIGS. 5*a*, 5*b*, 5*c*, 6, 7 and 16 of how the depth of the blade groove 18 may vary are employed in one and the same refining surface, for instance, in different refining zones of the refining surface, i.e. at different distances from the direction of the feed edge 13 of the refining surface to the direction of the discharge edge 14 of the refining surface. Further, it is also possible that the stator 2 shown in FIGS. 5*a*, 5*b*, 5*c*, 6, 7 and 16 is replaced by a second rotor whose rotating direction is reversed to the rotating direction R of the rotor shown in FIGS. 5*a*, 5*b*, 5*c*, 6, 7 and 16.

By arranging the blade grooves, which meet one another on the opposing refining surfaces when the refiner is in operation, to change in depth, it is possible to provide a solution which allows transfer of fibrous material via the blade gap 6 from one refining surface to another to be controlled. The solution may affect how large a portion of the fibrous material to be refined is subjected to refining in the blade gap and how often a given portion of the fibrous material will be subjected to refining in the blade gap. Thus the refining may affect both the refining grade of the fibrous material and the homogeneity of the refining.

The longitudinal direction, or run direction, of the blade bars 17 and the blade grooves 18 on the upper surface of the grinding refining surface portions 16 is the direction in which they run between two adjacent first refining surface portions 15. The distance between the two adjacent first refining surface portions 15, in other words, the length of the blade bars 17 and the blade grooves 18 locating between two adjacent first refining surface portions 15, in the run direction thereof, may be 20 to 120 mm, for instance. In embodiments to be described later, in which the blade bars 17 and the blade grooves 18 are not necessarily located between two adjacent first refining surface portions, the length of the blade bars 17 and the blade grooves 18 may be even longer. The first refining surface portions are placed so densely onto the refining surface that a uniform feed of material to be refined throughout the refining surface area will be provided. Appropriate density for the placement of the first refining surface portions 15 is selected on the basis of the material to be refined. The width of the blade bars 17 on the upper surface of the grinding refining surface portions 16, i.e. the dimension perpendicular to the longitudinal direction of the blade bars 17 and the blade grooves 18, may be 0.5 to 5 mm and the width of the blade grooves 18 may be 0.5 to 5 mm. The width of the blade bars 17 and the blade grooves 18 may also be below or above said variation ranges.

When the depth of the blade groove 18 is arranged to decrease or become shallower in the run direction of the blade groove 18, this controls the material to be refined to move from the refining surface into the blade gap 6 and further onto the second refining surface, i.e. the opposing refining surface. The resulting transfer of the material to be refined may be enhanced, when the width of the blade groove 18 is reduced, i.e. the blade groove 18 is made narrower, at the same time. In its run direction the blade groove 18 may be, at the beginning of the blade groove 18, at the first refining surface portion 15, for instance 6 mm deep, and become shallower such that at the end of the blade groove, at a next first refining surface portion 15, the depth of the blade groove 18 is 3 mm, for instance. In addition to the variation in depth, for instance, the width of the groove may also become narrower, e.g. from 3 mm to 2 mm in width, whereby the volume of the blade groove 18 is altered as a result of a change in both the depth of the blade groove 18 and the width of the blade groove 18.

The variation range of the change in blade groove depth is advantageously such that the depth of the blade groove 18 changes by becoming 1 to 4 mm shallower or deeper in the run direction of the groove from the first refining surface portion 15 to the second refining surface portion 15.

The variation range of 1 to 4 mm in the depth of the blade groove 18 is implemented, for instance, by a blade groove 18 having a depth of 4 to 6 mm or 7 to 10 mm, for instance, at the first refining surface portion 15, and 2 to 5 mm or 6 to 9 mm at the subsequent first refining surface portion 15. The change of 1 to 4 mm in the depth of the blade groove 18 provides a suitable pressure or low-pressure effect between the refining surfaces such that the material to be refined moves appropriately between the refining surfaces augmenting the refining grade and providing refining of uniform quality. In some cases, a greater change makes the material to be refined move yet more efficiently from the blade groove 18 to the blade gap 6, but a shortened service life of the refining surfaces or more easily blocked blade grooves 18 may pose a problem.

In some cases, a change in the depth of the blade groove 18 on the length of the blade groove 18 may be just 1 to 2 mm. A refining surface having a 1 to 2 mm change in depth in the blade groove 18 may be used longer thanks to a greater minimum height of the blade bars 17 and the resulting larger wear margin. Thus, for instance, if the depth of the blade groove 18 is e.g. 4.5 mm at one first refining surface portion 15, and it becomes deeper in the run direction of the blade groove 18 such that the depth of the blade groove 18 is 6 mm at a subsequent first refining surface portion 15, the wear margin of the blade bar 17 of the refining surface is 4.5 mm. As the wear margin of the blade bar 17 comes to an end, the friction surface of the refining surface reduces, power input declines and the refining effect obtained by the refiner decreases. A refining surface, in which the change in the depth of the blade groove 18 is 1 to 2 mm, does not direct the material to be refined so efficiently into the blade gap 6 as a refining surface with a greater change in the depth of the blade groove 18, yet it allows a sufficient control effect to be obtained. Particularly in such refining that heavily wears the refining surfaces the longer service life of the refining surface of this kind may be the best solution in overall economic assessment.

In addition to the change in the depth of the blade groove 18, the volume of the blade groove 18 may also be changed by altering the width of the blade groove 18 in the longitudinal direction of the blade groove 18, whereby it is possible to affect the transfer of the material to be refined from the refining surface to the refiner blade gap 6 and/or from the refiner blade gap 6 to the refining surface with changes in both the depth and the width of the blade groove 18. A change in the width of the blade groove 18, in the longitudinal direction of the blade groove 18, may be 0.5 to 2 mm, for instance. Thus, if the width of the blade groove 18 is e.g. 5 mm at a first end of the blade groove 18, at one first refining surface portion 15, the width of said blade groove 18 may be 3 to 4.5 mm at a second end thereof, at a subsequent first refining surface portion 15. When the volume of the blade groove 18 may be changed in the run direction of the blade groove 18 by changing both the depth and the width of the blade groove 18, it will be easier to optimize the manufacturing costs of the refining surface and still provide a refining effect which acts on the fibrous material to be refined.

Figure 15A:
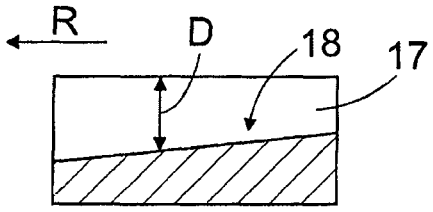
FIGS. 15*a* to 15*d* schematically show a blade groove.
Figure 15C:
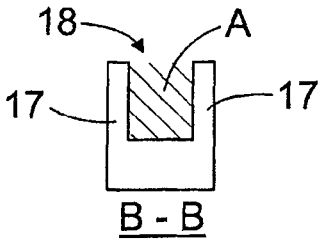
Figure 15B:
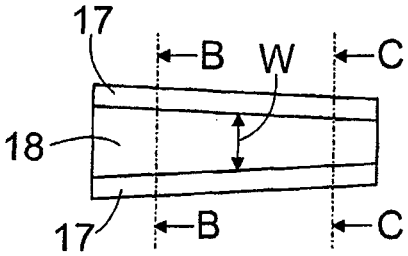
Figure 15D:
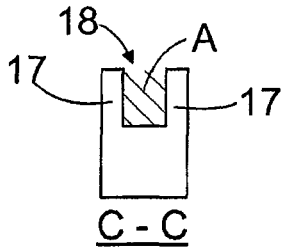

FIGS. 15*a* to 15*d* show schematically yet another blade groove 18 and change in the depth D and width W of the blade groove 18 in the longitudinal direction of the blade groove 18. FIG. 15*a* is a side view and FIG. 15*b* is a top view of the blade groove 18. FIG. 15*c* is a cross-sectional end view of the blade groove 18 along a cross-section line B-B and FIG. 15*d* is a cross-sectional end view of the blade groove 18 along a cross-section line C-C. The rotating direction of the rotor is indicated by reference R in FIG. 15*a*. It appears from FIGS. 15*a* and 15*b* that the depth D of the blade groove 18 and the width W of the blade groove 18 increase in the same direction with the rotating direction R of the rotor. Consequently, the cross-sectional area A of the blade groove 18, indicated by reference A in FIG. 15*d*, is smaller than the cross-sectional area A of the blade groove 18 in FIG. 15*c*. In the blade groove 18 of FIGS. 15*a* to 15*d*, the cross-sectional area A of the blade groove 18 is thus arranged to increase in the same direction with respect to the rotating direction R of the rotor, and consequently, as the rotor R rotates, the volume of the blade groove 18 is larger in the starting part of the blade groove 18 than in the end part of the blade groove 18. The depth D of the blade groove 18 thus represents the distance of the bottom of the blade groove 18 from the upper surface of the blade bars 17 adjacent to the blade groove 18, and the width W of the blade groove 18 represents the mutual distance of the blade bars 17 on either side of the blade groove 18.

The cross-sectional area A of the blade groove 18 shown in FIGS. 15*a* to 15*d* is thus arranged to change in the run direction or longitudinal direction of the blade groove 18 as a result of a change in both the depth D and the width W of the blade groove 18. The cross-sectional area A of the blade groove 18 could also change, however, only as a result of a change in either depth D or width W of the blade groove 18. As the cross-sectional area A of the blade groove 18 changes, the volume of the blade groove 18 changes, and the cross-sectional area A of the blade groove 18 corresponding to a given cross-section point in the blade groove 18 represents the cross-sectional volume of the blade groove 18 at said point in the blade groove 18.

In short-fibre refining the maximum depth of the blade grooves 18 is often 6 mm at most, and consequently the width of the blade bars 17 and the blade grooves 18 is often 0.5 to 3 mm. In long-fibre refining the maximum depth of the blade grooves 18, in turn, is 10 mm at most and in that case the width of the blade bars 17 and the blade grooves 18 is often 3 to 5 mm. The length of short fibers is typically less than 1.2 mm and particularly less than 1.0 mm. Long fibers, in turn, are typically over 1.5 mm in length, particularly over 2 mm in length.

In short-fibre refining there is produced a greater hydraulic buoyant force than in long-fibre refining. On the other hand, the long fibre rises easier than the short fibre off the blade grooves 18 into the blade gap 6 and also remains longer in the blade gap 6 than the short fibre. Because of these facts the axial force required in refining is lower in short-fibre refining than in long-fibre refining, and consequently application of the change in cross-sectional area of the blade groove 18 to the short-fibre refining differs to some extent from the application to the long-fibre refining.

In short-fibre refining 60 to 90% of the blade grooves 18 in the refining surface 1' of the rotor 1 may be arranged such that the cross-sectional area, i.e. depth or width, of the blade groove 18 increases in the same direction with the rotating direction R of the rotor 1, whereby they direct the flow of the material to be refined from the direction of the refining surface of the rotor 1 to the direction of the refining surface of the stator 2. The rest, i.e. about 10 to 40%, of the blade grooves 18 in the refining surface of the rotor 1 may be arranged such that their cross-sectional area decreases in the same direction with the rotating direction R of the rotor 1, whereby they direct flow of the material to be refined from the direction of the refining surface of the stator 2 to the direction of the refining surface of the rotor 1. In that case 80 to 100% of the blade grooves 18 in the refining surface of the stator 2 may be arranged such that their cross-sectional area decreases in the same direction with the rotating direction R of the rotor 1, whereby they direct flow of the material to be refined from the direction of the refining surface of the stator 2 to the direction of the refining surface of the rotor 1. The rest, i.e. about 0 to 20% of the blade grooves 18 in the refining surface of the stator 2 may be arranged such that their cross-sectional area increases in the same direction with the rotating direction R of the rotor 1, whereby they direct the material to be refined from the direction of the refining surface of the rotor 1 to the direction of the refining surface of the stator 2.

In long-fibre refining 40 to 80% of the blade grooves 18 in the refining surface 1' of the rotor 1 may be arranged such that the cross-sectional area, i.e. depth or width, of the blade groove 18 increases in the same direction with the rotating direction R of the rotor 1, whereby they direct the flow of the material to be refined from the direction of the refining surface of the rotor 1 to the direction of the refining surface of the stator 2. The rest, i.e. about 20 to 60%, of the blade grooves 18 in the refining surface of the rotor 1 may be arranged such that their cross-sectional area decreases in the same direction with the rotating direction R of the rotor 1, whereby they direct flow of the material to be refined from the direction of the refining surface of the stator 2 to the direction of the refining surface of the rotor 1. In that case 40 to 80% of the blade grooves 18 in the refining surface of the stator 2 may be arranged such that their cross-sectional area decreases in the same direction with the rotating direction R of the rotor 1, whereby they direct flow of the material to be refined from the direction of the refining surface of the stator 2 to the direction of the refining surface of the rotor 1. The rest, i.e. about 20 to 60% of the blade grooves 18 in the refining surface of the stator 2 may be arranged such that their cross-sectional area increases in the same direction with the rotating direction R of the rotor 1, whereby they direct the material to be refined from the direction of the refining surface of the rotor 1 to the direction of the refining surface of the stator 2.

Figure 8:
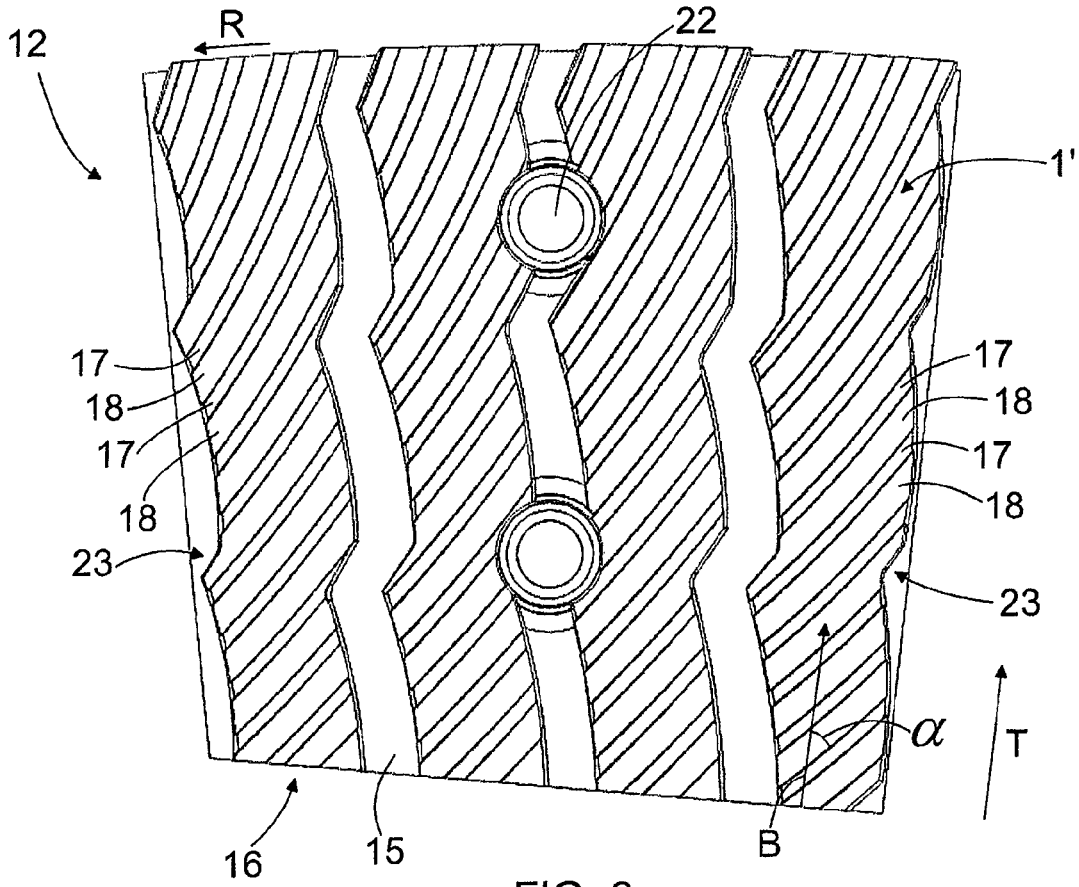
FIG. 8 schematically shows a blade element seen in the direction of a refining surface of the blade element.
Figure 9:
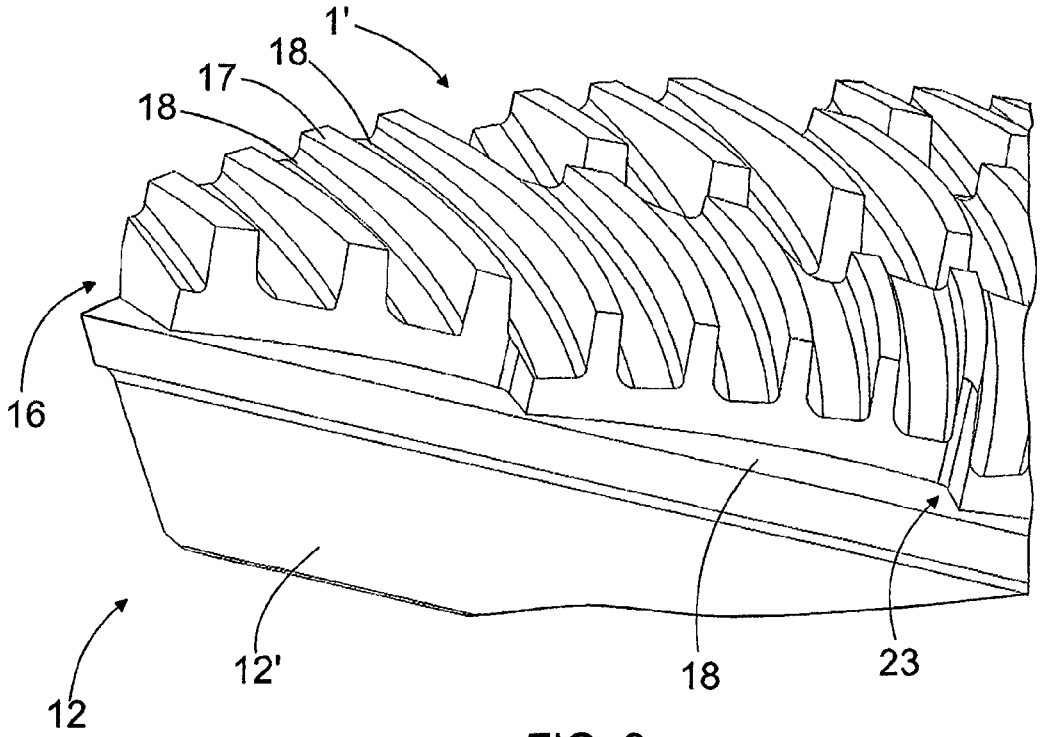
FIG. 9 schematically shows part of the blade element of FIG. 8 seen obliquely from above.

FIG. 8 shows schematically a blade element 12 seen in the direction of the refining surface thereof, and FIG. 9 shows schematically part of the upper left corner of the blade element 12 of FIG. 8, seen obliquely from above. The blade element 12 of FIG. 8 is a so-called blade segment which forms part of the refining surface of a refiner stator or rotor, and the whole refining surface will be provided by placing several blade elements 12 of FIG. 8 side by side. FIG. 8 shows schematically a securing opening 22 in the blade element 12, into which a securing element, such as a bolt, is to be inserted and the blade element 12 can be secured therewith to the rotor 1 or the stator 2 of the refiner. In the example of FIGS. 8 and 9 it is assumed that the blade element 12 is part of the refining surface 1' of the refiner rotor 1, yet the blade element 12 of FIGS. 8 and 9 could also be part of the refining surface 2' of the refiner stator 2. The blade element 12 of FIGS. 8 and 9 comprises a frame structure 12' of the blade element 12 and the blade element's 12 refining surface 1' provided on the upper surface thereof.

The blade element 12 of FIGS. 8 and 9 comprises first refining surface portions 15, which in the example of FIGS. 8 and 9 are in the shape of a groove, which run substantially parallel to the radius, indicated by arrow T, of the refining surface 1' from the direction of the feed edge 13 of the refining surface 1' to the direction of the discharge edge 14 of the refining surface 1' and whose task is to convey fibrous material to be refined, and already refined, on the refining surface 1'. Between the first refining surface portions 15 there are second refining surface portions 16, on the upper surface of which there are blade bars 17 of the refining surface 1' and between them blade grooves 18. It appears from FIG. 9 that the depth of the blade grooves 18 is arranged to change longitudinally such that, in view of the rotating direction R of the rotor 1, the depth of the blade groove 18 becomes lower in the opposite direction to the rotating direction R of the rotor 1. Thus, the structure of the blade grooves 18 corresponds substantially to that of the blade grooves 18 of the rotor 1 shown in FIG. 5*a*, 5*b*, 5*c*, 6 or 16.

As FIG. 8 is observed, it further appears that the blade bars 17 and the blade grooves 18 are oriented to be at a pumping blade angle. A pumping blade angle refers to such an angle that provides in the fibrous material to be refined both a speed component in the circumferential direction of the refining surface and a speed component in the radial direction of the refining surface, which speed component in the radial direction of the refining surface is directed from the direction of the feed edge of the refining surface to the direction of the discharge edge of the refining surface and thus it enhances the passage of the fibrous material to be refined from the feed direction of the fibrous material to be refined to the discharge direction of the refined material. The blade angle, in turn, is an angle between an imaginary line projected from the refining surface axis to the refining surface and a blade bar. In FIG. 8, in the lower right corner said imaginary line is depicted by arrow B and the blade angle by reference. The blade angle of the blade bars 17 and the blade grooves 18 positioned at the pumping blade angle may be 5 to 85 degrees. Blade angle values below or above this do not provide a significant pumping effect. The value of the blade angle may also vary in various zones of the refining surface, for instance, such that in the feed zone of the refining surface, i.e. in the refining surface zone closer to the feed edge there is used a large pumping blade angle, e.g. of 40 to 80 degrees, more preferably 50 to 80 degrees or 45 to 80 degrees, whereby a volume change in the blade groove directs material to be refined more effectively into the blade gap. In the actual refining zone or discharge zone of the refining surface, in other words, in refining surface zones locating further away from the feed edge of the refining surface, there is used a smaller pumping blade angle, e.g. of 20 to 40 degrees. The above given blade angle values concern blade bars and blade grooves arranged in a pumping manner, yet said blade angle values could also concern blade bars and blade grooves arranged in a retaining manner, when transfer of material to be refined is observed from the blade groove to the blade gap by the effect of a change in the blade groove volume. In the feed zone, the wider blade angle of the refining surface accelerates the movement of the fibrous material from the feed zone to the refining zone, whereas the smaller blade angle of the refining surface prolongs the dwell time of the material to be refined in the refining zone so as to increase the refining grade of the material to be refined.

By positioning the blade bars of the refining surface at a pumping angle it is possible to increase the capacity of the refiner, because the dwell time of the material to be refined in the refiner blade gap becomes shorter. At the same time, the change in refining grade of the material to be refined is smaller. Correspondingly, to position the blade bars of the refining surface at a retaining angle reduces the capacity of the refiner, because the dwell time of the material to be refined in the refiner blade gap increases. At the same time, the change in refining grade of the material to be refined is greater.

When the cutting angle between the blade bars 17 acting as a counterpart pair increases to at least 90 degrees, the blade grooves 18 with changing cross sectional area direct the material to be refined efficiently towards the opposing refining surface into the blade gap 6 by the effect of the blade bars 17 encountering one another, whereby the refining by the refiner is enhanced. At the same time, pressure effect is created in the blade gap between the opposing refining surfaces, which efficiently prevents the opposing refining surfaces from coming into contact with one another, i.e. the so-called blade contact, which could damage the refining surfaces. In conventional, previously known, refiners, in which the depth of the blade groove is constant, the material to be refined would only tend to pass in the blade grooves 18 without being refined, if the corresponding blade angle were used.

Even though 40 to 80 degrees is a particularly suitable blade angle in the feed area, it may also be advantageous in the refining area, for instance, when it is desired that the material be transferred particularly heavily throughout into the blade gap and that the refining have large capacity. Correspondingly, even though 20 to 40 degrees is an advantageous blade angle particularly in the refining area, it may also be advantageous in the feed area, for instance, when a longer refining treatment is needed and the refining capacity allows compromises to be made.

The larger the blade angles, in particular those between 50 to 85 degrees, the closer to the circumferential direction of the blade element 12 the blade bars 17 and the blade grooves 18 therebetween are oriented. In that case, the refining surface opposing to the refining surface observed causes, during refining, a force effect on the refining surface observed, which tends to convey the material to be refined more and more in the direction of the blade grooves 18. In this situation, the depth or volume of the blade groove 18 that changes in the longitudinal or run direction forces the material to be refined, moving in parallel with the blade groove 18, to shift from the refining surface observed towards the opposing refining surface and hence into the blade gap 6 to be refined. Thus, also such refining surfaces 1' of the rotor 1 and refining surfaces 2' of the stator 2 that employ large blade angles allow the fibrous material to be conveyed efficiently into the blade gap 6 of the refiner for being refined.

When the blade angles are large and they are oriented in a pumping direction both on the refining surface 1' of the rotor 1 and on the refining surface 2' of the stator 2, the blade bars direct the fibrous pulp, by the effect of the cutting direction between the blade bars 17 on the opposing refining surfaces, into the blade gap 6 and from the feed edge 13 of the refining surface towards the discharge edge 14 of the refining surface. The blade bars 17 direct the fibrous material efficiently into the blade gap 6 for being refined and move it from the feed zone to the refining zone and the discharge zone, for instance with a refining surface implementation, in which the cutting angle between the blade bars acting as a counterpart pair is 100 to 120 degrees, the blade angle being thus 50 to 60 degrees per refining surface, when the same blade angle is used in both refining surfaces. When the blade bars 17 of the opposing refining surface are oriented in a pumping direction and when the blade angle is at least 50 degrees, and additionally, when at least on one refining surface the groove volume of the blade grooves 18 decreases or increases in the direction of pulp motion, it further enhances the transfer of material into the blade gap 6 for being refined and conveys the material from the feed edge 13 of the refining surface to the discharge edge 14 of the refining surface. The reducing groove volume makes the fibrous material move into the blade gap 6 by the effect of rising pressure in the blade groove 18. Correspondingly, an increasing groove volume makes the fibrous material move from the refining surface opposite to that observed into the blade gap 6 by the effect of suction caused by the decreasing pressure in the blade groove.

The blade bars 17 of the refining surface and the blade grooves 18 therebetween may be straight. The blade bars 17 of the refining surface and the blade grooves 18 therebetween may, however, be curved as schematically shown in FIGS. 8 and 9 in such a manner that the blade bars 17 form in the refining surface, seen perpendicularly thereto, a wave pattern as appears from FIG. 8. The wave pattern provided by the blade bars 17 in the refining surface is formed, when the orientation of the blade bars 17 employs regularly repeated small radii of curvature. The structure of the blade bars 17, which is curved and comprises small radii of curvature, increases the loading capacity of the blade bars 17 in such a manner that they resist better than before the refining load exerted thereon. Improved strength of the blade bars 17 over previous blade solutions is emphasized when the blade angle is small, for instance when the blade angle values are 20 to 30 degrees. In a situation, where a hard particle, which damages the blade bar 17, is caught between the blade bars 17, thanks to the curved, wave-formed structure of the blade bars 17 there is caused a damage that only affects the blade bar 17 on a short length. In a situation like this, the structure of a conventional blade bar would be damaged completely or at least for a considerably greater length.

In the blade element of FIG. 8, in the run direction of the blade bars 17 and the blade grooves 18 the blade angle at the beginning of the blade bar 17 or the blade groove 18, or at the beginning of the wave pattern, is larger and becomes smaller herefrom towards the end of the blade bar 17 or the blade groove 18, or towards the end of the wave pattern, when the starting point of the blade bar 17 or the blade groove 18 is determined to be the end of the blade bar 17 or the blade groove 18 that is oriented in the same direction with the rotating direction R of the rotor 1. Consequently, the material refined by the starting part of the blade bar 17 has a stronger tendency to pass in the run direction of the blade groove 18 and to move from the blade grooves 18 into the blade gap 6 by the effect of the pressure or negative pressure caused by a change in the groove depth, and the end part of blade bar 17 serves as a blade bar enhancing the refining.

When the blade angle of the blade bar in the blade element is large as arranged in the refiner, the blade bar in the blade element directs the fibrous material to a great extent in the direction of the blade bar and the blade groove of the blade element by means of the force produced by the opposing blade surface. As a result, the fibrous material to be refined rises efficiently into the blade gap. Thus, when the blade angle of the blade bar is large, the fibers, upon rising into the blade gap, tend to move along the blade bar and to some extent adhere to the blade bars, which particularly makes the fibrous material be refined. When the blade angle in the blade element is small, by means of the force produced by the opposing blade surface the blade bar in the blade element directs the fibrous material less in the direction of the blade groove, whereby the fibrous material rises less efficiently into the blade gap. To the extent the fibrous material still rises into the blade gap, the blade bar moving mostly crosswise to the groove grips the fibers effectively, and consequently energy transfer to the fibers takes place easily, and the fibrous material is subjected to heavy refining. When the blade bar is curved, the starting part of the blade bar makes the fibrous material move efficiently into the blade gap and the end part makes the fibrous material be subjected to heavy refining.

The blade elements, whose refining surface comprises on the length of the blade groove 18 a varying or changing groove volume, i.e. changing groove depth and/or changing groove width, and in which the blade bars 17 are arranged to pump by using a blade angle exceeding 50 degrees and/or in which the blade bars 17 are arranged to form a wavy blade bar and blade groove pattern, provide efficient refining of high quality in the material to be refined and further a high production capacity.

Groove-shaped material feed grooves in the refining surface of the blade element 12 of FIGS. 8 and 9 constitute the first refining surface portions 15 that comprise bends 23. In the longitudinal direction of the first refining surface portion 15, at the curved portion between two bends 23 the speed of the material to be refined will be accelerated. At the bend 23 the material having accelerated speed impacts a wall of the groove-shaped first refining surface portion, which enhances the transfer of the material to be refined into the blade gap 6 and the blade grooves 18 participating in the actual refining.

Groove-shaped material feed grooves in the refining surface of the blade element 12 of FIGS. 8 and 9 constituting the first refining surface portions 15 are also directed to run substantially in the radial direction T of the refining surface. By orienting the feed grooves 15 to run substantially in the radial direction of the refining surface it is possible to provide high hydraulic capacity as the fibrous material flow in the feed groove 15 takes a short route from the feed edge to the discharge edge of the refining surface. In addition, said arrangement distributes the material efficiently throughout the refining surface area so that the proportion of the feed grooves 15 of the surface area of the refining surface can be kept small. In some cases the feed grooves 15 may be arranged to be retaining, whereby they decelerate passage of the material to be refined in the blade gap, thus enhancing the refining effect to which the fibrous material is subjected. Correspondingly, sometimes it may be necessary to further enhance the pumping effect of the feed grooves 15 by arranging the feed grooves 15 in the pumping direction.

Further, in the refining surface of the blade element 12 of FIGS. 8 and 9 the blade bars 17 and the blade grooves 18 are positioned at least to some extent in the circumferential direction of the refining surface, i.e. in the tangential direction of the refining surface or in the transversal direction in relation to the first refining surface portions 15. In addition, the width of the first refining surface portions 15, i.e. the feed grooves 15, is arranged to change on the length of the groove 15 so that the groove 15 is arranged to narrow in the portions between the bends 23 of the groove 15 when transferring from the direction of the feed edge 13 of the refining surface to the direction of the discharge edge 14 of the refining surface. The broader portions in the groove 15 contribute to convey material to be refined and already refined forward on the refining surface, but the tapering or narrower portions in the groove 15 retain the material and also contribute to force material to be refined into the blade grooves 18 and further into the blade gap 6 of the refiner.

Figure 10:
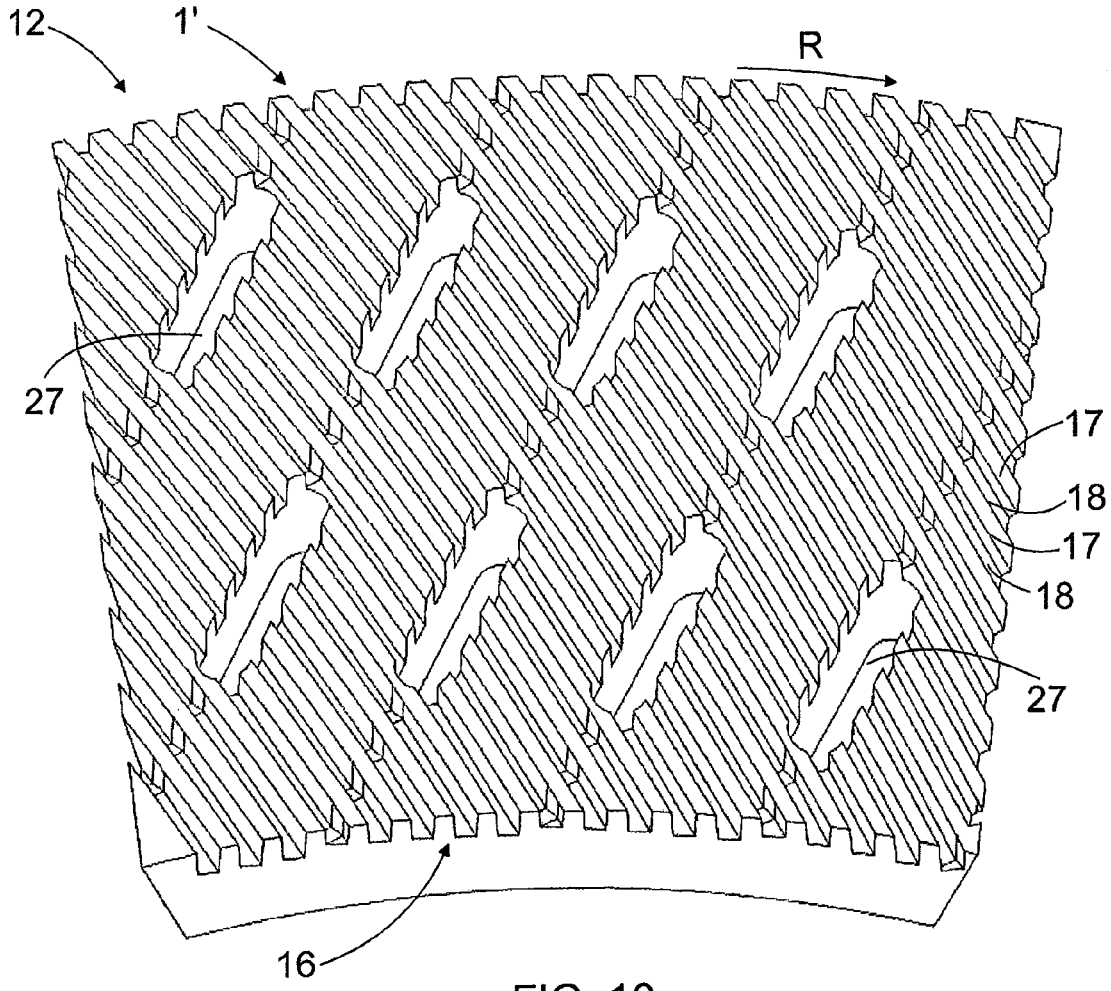
FIG. 10 schematically shows a second blade element seen in the direction of a refining surface of the blade element.
Figure 11:
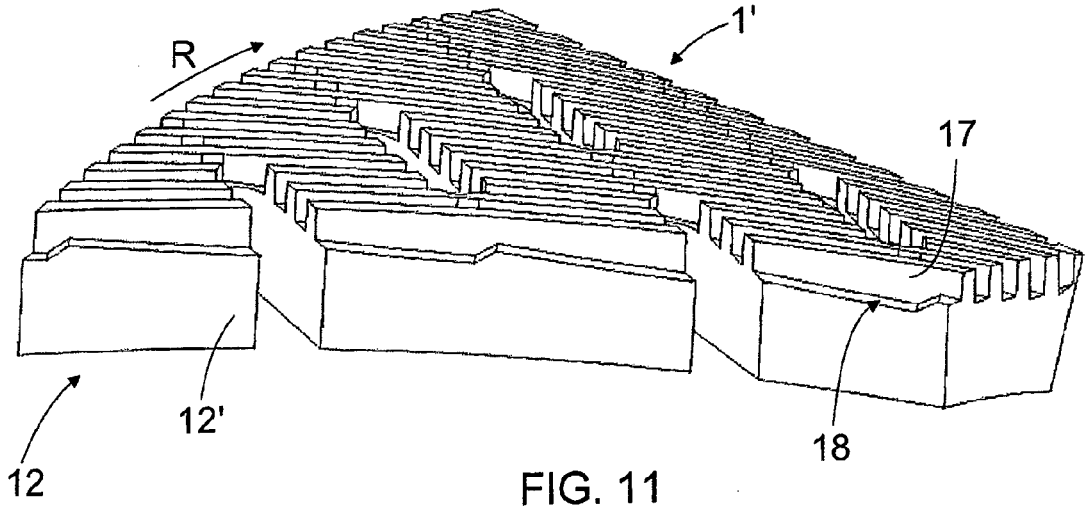
FIG. 11 schematically shows part of the blade element of FIG. 10 seen obliquely from above.

FIG. 10 shows schematically a second blade element 12 seen in the direction of the refining surface thereof, and FIG. 11 shows schematically part of the blade element 12 of FIG. 10, seen obliquely from above. The blade element 12 of FIGS. 10 and 11 is intended to form part of the refining surface 1' of the refiner rotor 1, yet a corresponding blade element 12 may also be used as a blade element in the refiner stator 2.

The blade element 12 of FIGS. 10 and 11 comprises blade bars 17 and blade grooves 18 whose structure is arranged to be in the longitudinal or run direction only slightly curved in the direction opposite to the rotating direction, indicated by reference R, of the rotor. Further, the blade element 12 comprises openings 27 provided through the refining surface 1' of the blade element 12. The blade element 12 of FIGS. 10 and 11 may be used, for instance, in the cone refiner 11, shown schematically in FIG. 14 and deviating from the cone refiner 11 of FIG. 2 in that, in the cone refiner 11 of FIG. 14, the fibrous material to be refined and fed through an opening 7 is transferred into the blade gap 6 through openings 27 in the refining surface of the rotor 1 and refined fibrous material is discharged from the blade gap 6 through openings 27 in the refining surface 2' of the stator 2 as schematically indicated by arrows F. The refined fibrous material is discharged from the blade gap 6 into an interspace 28 of the refiner 11 and further out of the refiner 11 via a discharge channel 9. Said openings 27 thus form the first refining surface portions 27 feeding material to be refined and/or the first refining surface portions 27 discharging refined material, and said blade bars 17 and blade grooves 18 are arranged on the upper surface of the refining surface portions 16 refining the material. In the blade element 12 of FIGS. 10 and 11 only part of the blade grooves 18 in the refining surface is arranged to connect said first refining surface portions 27. The depth of the blade grooves 18 is further arranged to change linearly in the longitudinal direction of the blade grooves 18, as schematically shown in FIG. 11.

Figure 14:
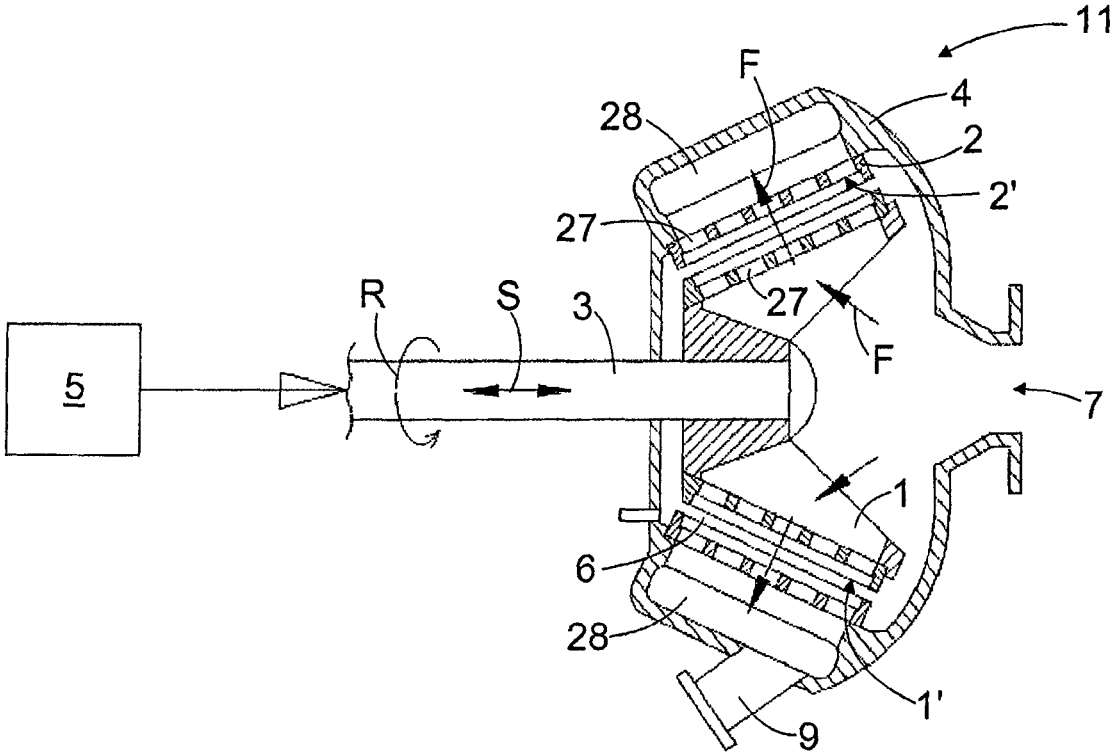
FIG. 14 schematically shows a side view of a cone refiner in cross-section.

The blade element 12 of FIGS. 10 and 11 may also be used in a refiner shown in FIG. 14, in which the fibrous material to be refined is fed into the blade gap 6 through openings 27 in the refining surface 2' of the stator 2 and the refined material is discharged from the blade gap 6 through openings 27 in the refining surface 1' of the rotor 1. Further, a refiner 11 similar to that in FIG. 14 could also be implemented so that only either the refining surface 1' of the rotor 1 or the refining surface 2' of the stator 2 comprises openings 27 through which fibrous material to be refined is fed into the blade gap 6, or through which the refined fibrous material is discharged from the blade gap 6.

Figure 12:
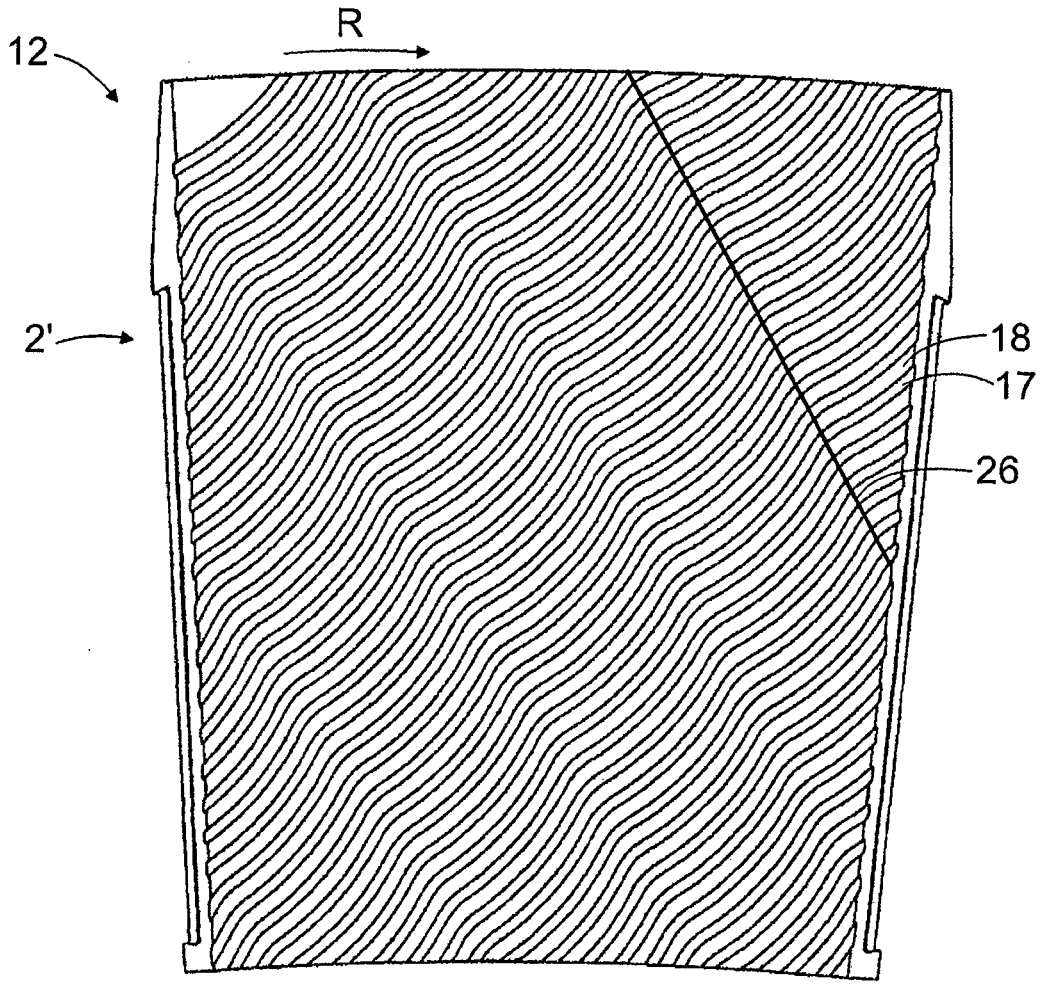
FIG. 12 schematically shows a third blade element seen in the direction of a refining surface of the blade element.
Figure 13:
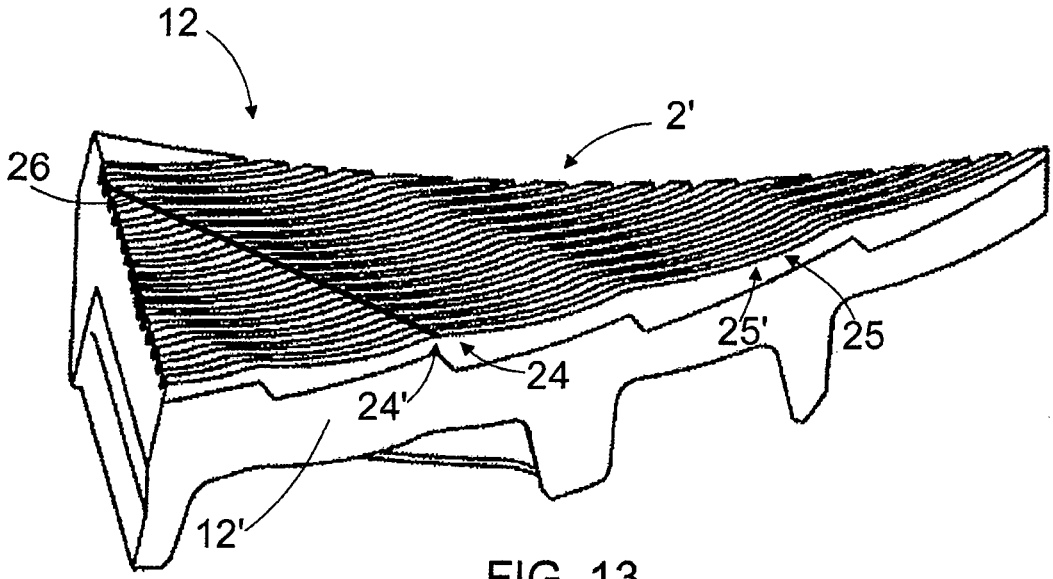
FIG. 13 schematically shows part of the blade element of FIG. 12 seen obliquely from above.

FIG. 12 shows schematically a third blade element 12, seen in the direction of the refining surface thereof, and FIG. 13 shows schematically part of the blade element 12 of FIG. 12, seen obliquely from above. The blade element 12 of FIGS. 12 and 13 may be used in the stator 2 of the refiner, and consequently the refining surface of the blade element 12 is indicated by reference 2'. The rotating direction of the rotor is indicated by reference R. The blade element 12 of FIGS. 12 and 13 is characterized in that it does not comprise first refining surface portions feeding material to be refined or discharging already refined material but that the refining surface 2' of the blade element 12 only comprises blade bars 17 and blade grooves 18 participating in the actual refining. In the implementation of the refining surface 2' of FIGS. 12 and 13, the blade bars 17 are preferably oriented such that they pump, which makes sure that the material to be refined moves on the refining surface 2' and, consequently, that the refining works and the production capacity is sufficient. By increasing the blade angle of the blade bars 17 it is possible to enhance the pumping effect and to augment the production capacity.

In the blade element 12 of FIGS. 12 and 13, the depth of the blade groove 18 is arranged to change in the longitudinal direction of the blade groove 18 in a wave-form manner, i.e. the bottom of the blade groove 18 comprises in a wave-like manner alternately convex portions 24 and concave portions 25. Said configuration of the bottom of the blade groove 18 is clearly seen in FIG. 13. The distance from the bottom of the blade groove 18 to the upper surface of the blade bar 17, in other words, the depth of the blade groove 18, is at its minimum at a wave crest 24' within the convex portions 24 of the bottom of the blade groove 18 and the distance from the bottom of the blade groove 18 to the upper surface of the blade bar 17 is at its maximum at a wave trough 25' within the concave portions 25 of the bottom of the blade groove 18. The wave crests 24' of the blade groove bottom in the adjacent blade grooves 18 may form transfer lines, of which one is indicated by reference 26 in FIGS. 12 and 13. The transfer lines 26 are lines extending beyond at least one portion in the refining surface, at which the depth of the blade grooves 18 between the blade bars 17 is at its minimum, i.e. at the transfer line 26 the adjacent blade grooves 18 comprise the wave crest 24' of the bottom of the blade groove 18. At said transfer lines 26 the material to be refined is forced to the refiner blade gap 6 by the effect of the movement in the material to be refined, caused by the blade bars 17 of the refining surface opposite to the refining surface observed, and the transfer lines 26 appearing on the refining surface observed. Thus, the transfer lines 26 make it possible to affect the dwell time of the material to be refined in the blade gap 6 and thereby the quality of the refined material. The transfer lines 26 may be oriented in relation to the blade angles of the blade bars 17 in such a manner that the transfer lines 26 deviate 30 degrees at most, preferably 20 degrees at most, from the direction perpendicular to the blade bars 17. In that case, when the blade bars 17 are positioned in a pumping manner, using a blade angle exceeding 50 degrees, for instance, the transfer lines 26 will fall at such an angle to the run direction of the blade bars 17 and the blade grooves 18 that they have a retaining effect on the passage of the material to be refined on the refining surface, which thus prolongs the dwell time of the material to be refined between the refining surfaces and augments the refining degree of the refined material.

In the refining surface 2' of the blade element 12 of FIGS. 12 and 13 the depth of the blade groove 18 changes in a wave-like manner comprising convex and concave portions, yet the depth of the blade groove 18 could also change linearly. Further, in the refining surface 2' of the blade element 12 of FIGS. 12 and 13 the blade bars 17 and the blade grooves 18 are arranged to be curved, yet they could also be substantially straight. The wavy configuration of the bottom of the blade groove 18 of FIGS. 12 and 13 could also be applied to such refining surfaces that comprise first refining surface portions feeding material to be refined onto the refining surface and/or discharging refined material from the refining surface and implemented in the form of grooves 15 or feed openings or discharge openings 27 provided in the refining surface.

In FIG. 8, the radius of curvature of the blade bars 17 is about 250 mm in such a manner that the blade bars 17 encounter the material to be treated as a concave surface. In FIG. 10, the radius of curvature of the blade bars 17 is large, almost straight, in such a manner that the blade bars 17 encounter the material to be treated as a slightly convex surface. In FIG. 12, the radius of curvature of the blade bars 17 is about 90 mm in such a manner that the blade bars 17 encounter the material to be treated as a concave surface. At a transfer line 26, the radius of curvature of the blade bars 17 is about 10 mm.

When the blade bar 17 is short, i.e. when the distance between two adjacent feed grooves 15 or the openings 27 feeding the material or discharging it is short, it is advantageous to use a smaller radius of curvature of the blade bars 17. In that case, even though the blade bar 17 is short, such a great change is provided in the blade angle of the blade bar 17 that the blade bar 17 will have a strong structure. The radius of curvature of a short blade bar 17 may also be small because of the fact that the total change in the blade angle of the blade bar 17 does not become excessive, and consequently the throughput of the material to be refined in the blade groove 18 of the refining surface remains high. Excessive total change in the blade angle of the blade bar 17 could make the refining surface more susceptible of blocking.

When the blade bar 17 is long, i.e. when the distance between two adjacent feed grooves 15 or the openings 27 feeding the material or discharging it is long, it is advantageous to use a larger radius of curvature of the blade bars 17. Even though the radius of curvature of the blade bar 17 is long, such a great change is provided in the blade angle of the blade bar 17 that the blade bar 17 will have a strong structure. In that case the total change in the blade angle of the blade bar 17 does not become excessive either, and consequently the throughput of the material to be refined in the blade groove 18 remains high. As the total change in the blade angle of the blade bar 17 remains relatively small, the blade groove 18 will keep open in use and pass the material to be refined effectively.

The strength of the blade bar 17 improves by reducing the curvature of the blade bar 17. Improvement in strength is achieved irrespective of whether the curved blade bar 17 is oriented concavely or convexly in the direction of movement, i.e. circumferential or tangential direction of the refining surface.

The radius of curvature of the blade bar 17 is preferably 50 to 300 mm, more preferably 50 to 150 mm. With smaller radius of curvature the structural strength of the blade bar 17 improves. The radius of curvature of the blade grooves 18 in the refining surface may be relatively small, if feed grooves 15 or openings 27 feeding or discharging material are placed relatively densely in the refining surface, in which case the capacity of the refining surface will be high despite the small radius of curvature of the blade bar 17 in the refining surface.

Figure 17:
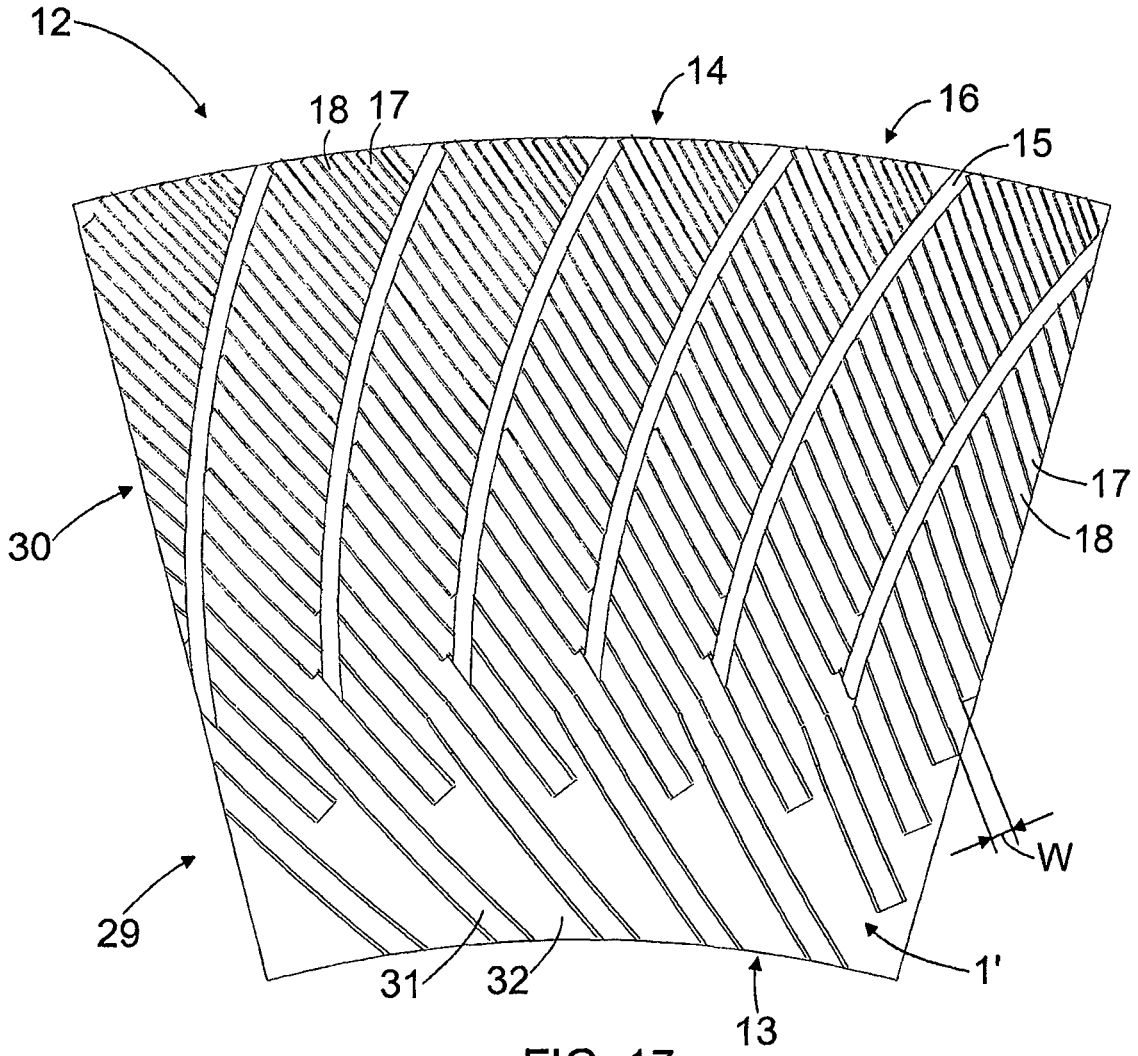
FIG. 17 is a schematic top view of a fourth blade element.

FIG. 17 is a schematic top view of a blade element 12 of a disc refiner. The blade element 12 includes a feed edge 13 and a discharge edge 14. The blade element 12 comprises a refining surface 1', in other words, the blade element 12 of FIG. 17 is intended to provide part of the refining surface of a refiner rotor, yet a corresponding blade element could also be employed to provide part of the refining surface of a refiner stator.

The blade element 12 of FIG. 17 further comprises first refining surface portions 15, implemented as grooves, and therebetween second refining surface portions 16 on the upper surface of which there are blade bars 17 and blade grooves 18, the cross-sectional area of the blade grooves 18 being arranged to change in the longitudinal direction of the blade grooves 18. Further, in the blade element 12 of FIG. 17 the blade bars 17 and the blade grooves 18 are arranged in the blade element 12 such that on the feed edge 13 side of the blade element 12 the blade bars 17 and the blade grooves 18 are arranged at a longer distance from one another, i.e. with wider mutual spacing, than on the discharge edge 14 side of the blade element 12, where the blade bars 17 and the blade grooves 18 appear more densely. Positioning of the blade bars 17 and the blade grooves 18 in the blade element 12 is thus arranged to become denser substantially continuously or regularly from the direction of the feed edge 13 to the direction of the discharge edge 14 of the blade element 12. Increasing density is provided by reducing the width of the blade bars 17 and the blade grooves 18 continuously or regularly from the direction of the feed edge 13 to the direction of the discharge edge 14 of the blade element 12. In the blade element of FIG. 17 the cross-sectional area of the blade grooves is thus arranged to change both in the longitudinal direction of the blade grooves 18 and from the direction of the feed edge 13 to the direction of the discharge edge 14 between consecutive blade grooves 18.

In the blade element 12 of FIG. 17 the refining surface 1' divides into two zones, a feed zone 29 or a crushing zone 29 located on the feed edge 13 side of the refining surface 1' and a refining zone 30 on the discharge edge 14 side of the refining surface 1'. The feed zone 29 comprises protrusions 31 and therebetween recesses 32. In the embodiment of FIG. 17 the protrusions 31 are implemented as blade bars and the recesses 32 as grooves, but depending on the embodiment, the implementation of the protrusions 31 and the recesses 32 may vary. The protrusions 31 perform coarse refining of the material to be refined and convey the material forward on the refining surface 1' via the recesses 32. The refining zone 30 comprises first refining surface portions 15, implemented as grooves, and therebetween second refining surface portions 16 on the upper surface of which there are blade bars 17 and blade grooves 18, as described above. Some of the protrusions 31 and recesses 32 of the refining zone may extend onto the refining zone 30 and form there part of the blade bar 17 or the blade groove 18.

Figure 18:
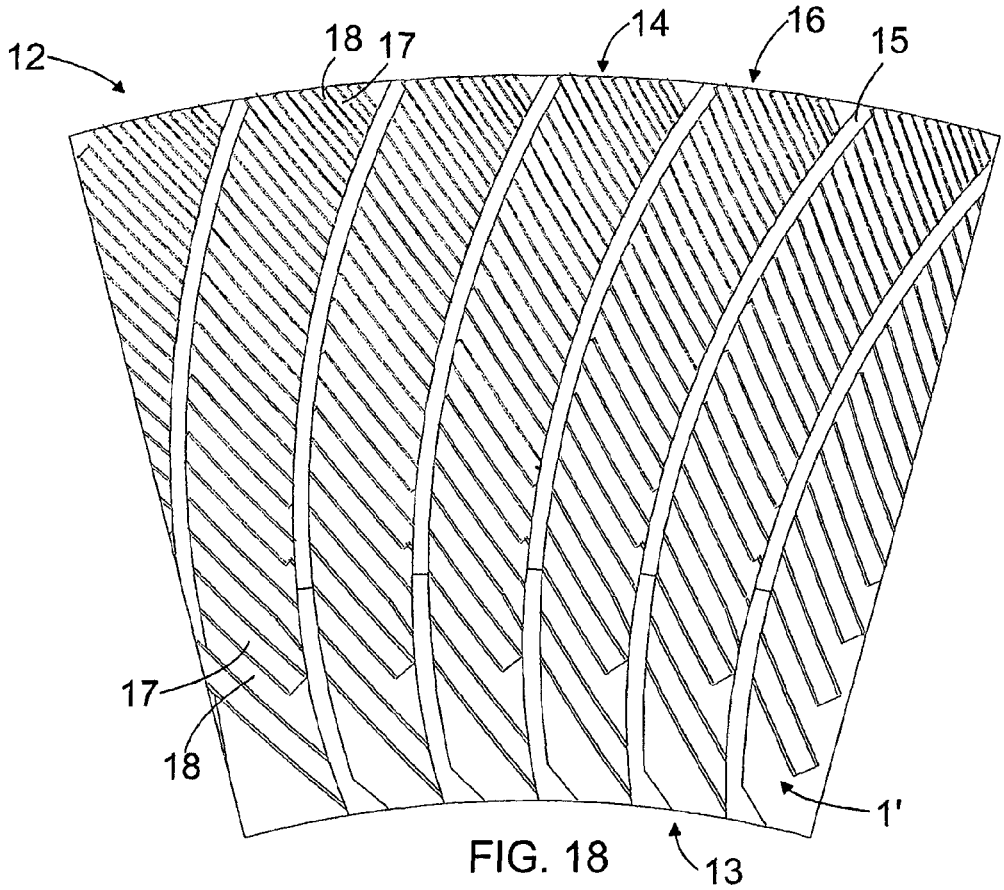
FIG. 18 is a schematic top view of a fifth blade element.

FIG. 18 also shows a top view of a disc refiner blade element 12, in which the positioning of the blade bars 17 and the blade grooves 18 in the blade element 12 is arranged to become denser substantially continuously from the direction of the feed edge 13 to the direction of the discharge edge 14 of the blade element 12 throughout the entire refining surface area from the feed edge 13 to the discharge edge 14.

Figure 19:
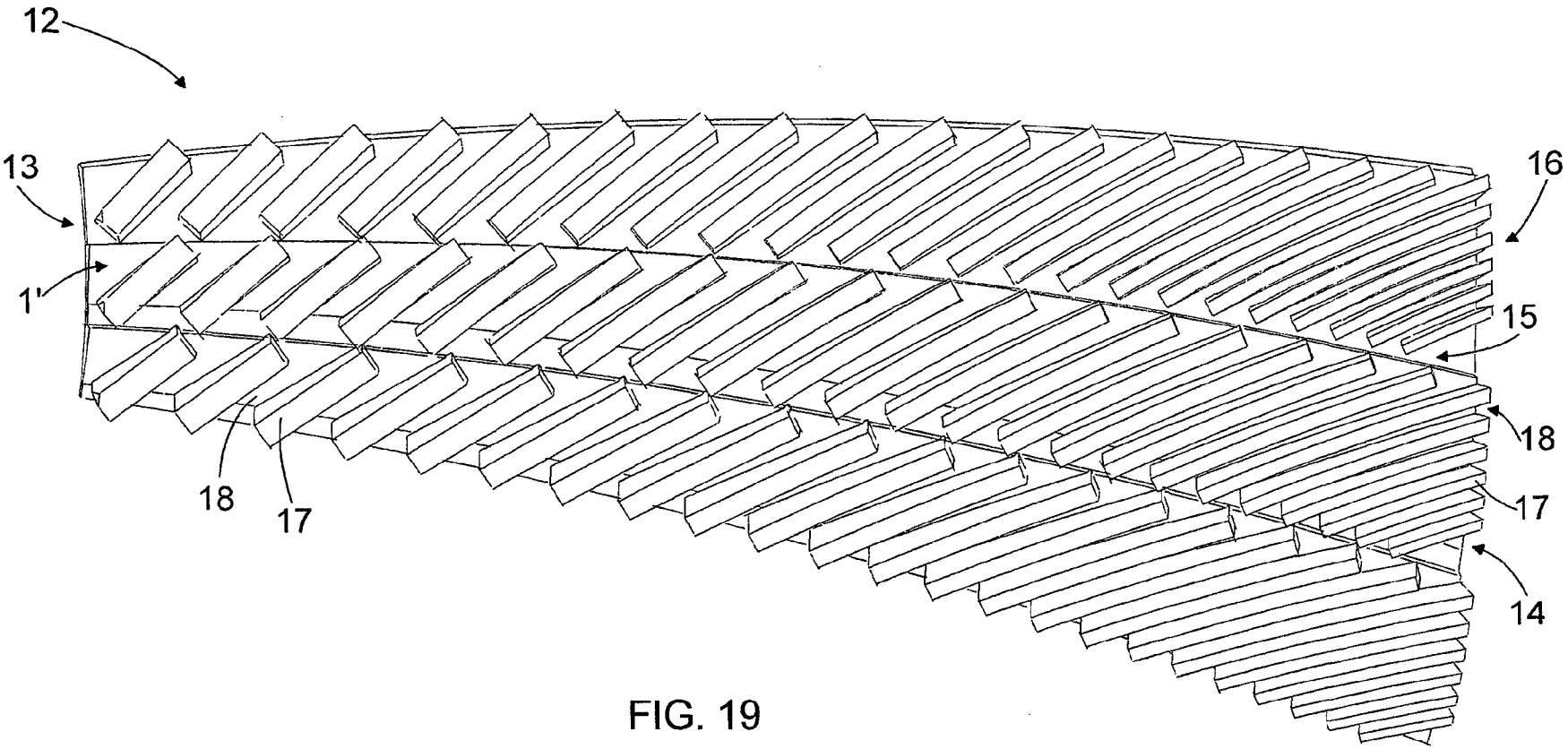
FIG. 19 is a schematic top view of a sixth blade element.

FIG. 19 shows schematically a cone refiner blade element 12. The blade element 12 includes a feed edge 13 and a discharge edge 14. The blade element 12 of FIG. 19 further comprises first refining surface portions 15, implemented as grooves, and therebetween second refining surface portions 16 on the upper surface of which there are blade bars 17 and blade grooves 18, the cross-sectional area of the blade grooves 18 being arranged to change in the longitudinal direction of the blade grooves 18. Further, in the blade element 12 of FIG. 19 the blade bars 17 and the blade grooves 18 are arranged in the blade element 12 such that on the feed edge 13 side of the blade element 12 the blade bars 17 and the blade grooves 18 are arranged at a longer distance from one another, i.e. with wider mutual spacing, than on the discharge edge side of the blade element 12, where the blade bars 17 and the blade grooves 18 appear more densely. Positioning of the blade bars 17 and the blade grooves 18 in the blade element 12 is thus arranged to become denser substantially continuously from the direction of the feed edge 13 to the direction of the discharge edge 14 of the blade element 12 by reducing the width of the blade bars 17 and the blade grooves 18 continuously from the direction of the feed edge 13 to the direction of the discharge edge 14 of the blade element 12, as described above. The blade element 12 of FIG. 19 is intended to provide part of the refining surface of a refiner rotor, yet a corresponding blade element could also be employed to provide part of the refining surface of a refiner stator.

Figure 20:
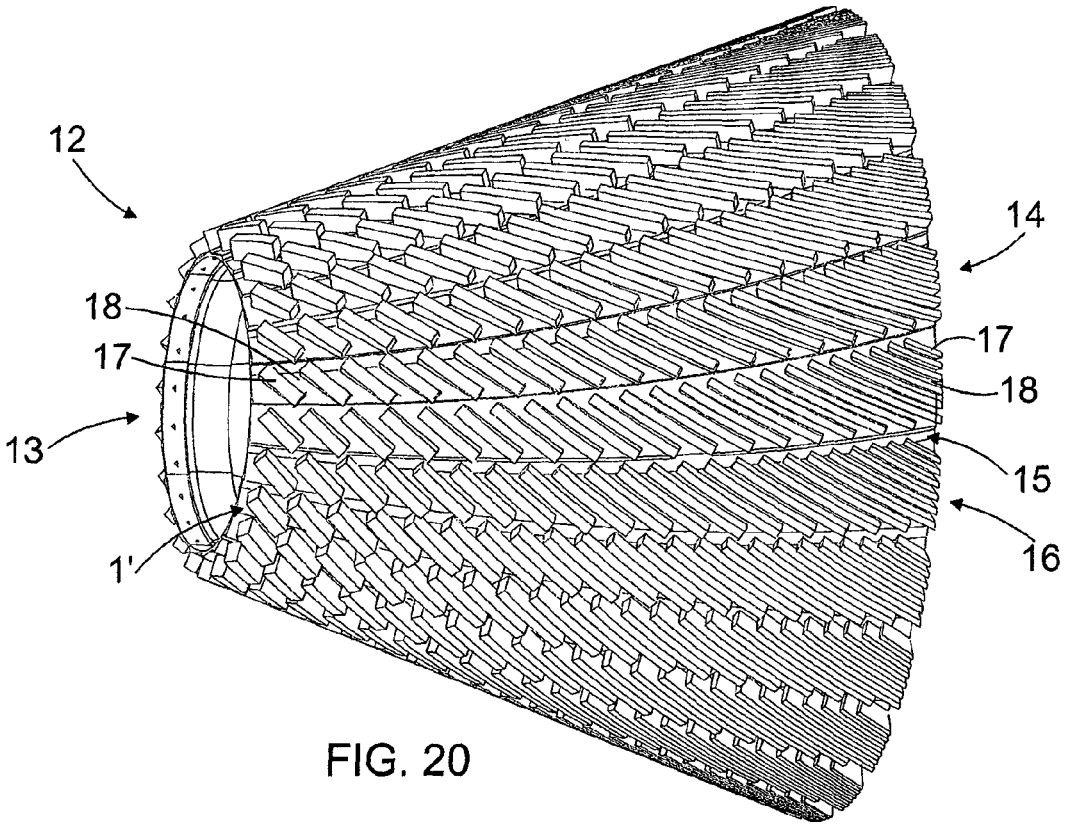
FIG. 20 is a schematic top view of a seventh blade element.

FIG. 20 shows schematically a second cone refiner blade element 12, in which the positioning of the blade bars 17 and the blade grooves 18 in the blade element 12 is arranged to become denser substantially continuously from the direction of the feed edge 13 to the direction of the discharge edge 14 of the blade element 12. The blade element 12 of FIG. 20 is arranged to provide the whole refining surface of the cone refiner rotor, yet a corresponding solution could also be used for the refining surface of the cone refiner stator.

In the blade elements of FIGS. 17 to 20 the cross-sectional area of the blade grooves 18 is thus arranged to change both in the longitudinal direction of the blade grooves 18 and in transition from one blade groove 18 to the next from the direction of the feed edge 13 to the direction of the discharge edge 14 of the refining surface. The change in the cross-sectional area in the longitudinal direction of the blade grooves 18 may be analogous to that described in FIG. 5*a*, 5*b*, 5*c*, 6, 7 or 16. When transition from the direction of the feed edge 13 to the direction of the discharge edge 14 of the refining surface takes place, the cross-sectional area of the consecutive blade grooves 18, from one blade groove 18 to the next, decreases in such a manner that the width of the consecutive blade grooves 18 decreases, whereby the width of the blade bars 17 and the blade grooves 18 closest to the feed edge 13 of the refining surface is at its largest and closest to the discharge edge 14 of the refining surface at its smallest. Thus is provided a refining surface having the blade geometry with wider spacing on the feed side of the refining surface, which prevents the blade system from blocking on the feed side of the refining surface, where the material's refining grade is still very low. On the discharge edge side of the refining surface, in turn, the blade geometry has narrower spacing, whereby an efficient refining effect is achieved before the material to be refined exits the refiner. Continuous densening of the blade bars 17 and the blade grooves 18 also prevents groove-blocking discontinuities from being formed on the refining surface, which may occur on conventional refining surfaces comprising only refining surface zones of standard blade geometry, particularly when attempts are made to add blade bars to their blade geometry so as to change the refining effect. In addition, volume changes in the blade geometry of the refining surface may be readily affected by the continuous densening of the blade bars 17 and the blade grooves 18.

The width of the blade bars 17 and the blade grooves 18 may reduce about 20 to 40% from the feed edge 13 to the discharge edge 14 of the refining surface, or, in other words, the density of the blade bars 17 and the blade grooves 18 may increase about 20 to 40% from the feed edge 13 to the discharge edge 14 of the refining surface. The change in the width of the blade bars 17 and the blade grooves 18 of the refining surface from the feed edge 13 to the discharge edge 14 of the refining surface is also affected by the type of the material to be refined. For instance, when softwood pulp is refined, the width of the blade bar 17 at the feed edge of the refining surface may be e.g. 4 mm and at the discharge edge 3 mm, the width of the blade groove 18 being at the feed edge of the refining surface e.g. 6 mm and at the discharge edge 4 mm. When mixed pulp is refined, the width of the blade bar 17 at the feed edge of the refining surface may be e.g. 3.5 mm and at the discharge edge 2.5 mm, the width of the blade groove 18 being at the feed edge of the refining surface e.g. 4 mm and at the discharge edge 3 mm. When short-fibre pulp is refined, the width of the blade bar 17 at the feed edge of the refining surface may be e.g. 3 mm and at the discharge edge 2 mm, the width of the blade groove 18 being at the feed edge of the refining surface e.g. 3.5 mm and at the discharge edge 2.5 mm. When eucalyptus-based pulp is refined, the width of the blade bar 17 at the feed edge of the refining surface may be e.g. 2.5 mm and at the discharge edge 1.5 mm, the width of the blade groove 18 being at the feed edge of the refining surface e.g. 3 mm and at the discharge edge 2 mm.

In the blade elements of FIGS. 18 to 20 the cross-sectional area of the blade grooves 18 is arranged to reduce from the direction of the feed edge 13 to the direction of the discharge edge 14 between consecutive blade grooves 18 substantially throughout the whole refining surface area. However, an embodiment, in which the cross-sectional area A of consecutive blade grooves 18, seen from the feed edge 13 to the discharge edge 14, is reduced only within some limited portion between the feed edge 13 and the discharge edge 14, as in FIG. 17, is also possible. As the width of the blade grooves 18 decreases, also the width of the blade bars 17 may decrease, as schematically shown in FIGS. 17 to 20. However, such embodiments are also possible, where the width of the blade bars 17 remains constant as the width of the blade grooves 18 decreases, or the width of the blade bars 17 decreases only in a portion of the refining surface.

In the embodiment of FIG. 17 the continuous densening of the blade bars 17 and the blade grooves 18 is thus implemented in a refining zone 30 subsequent to the particular feed zone 29 of the refining surface 1', the essential matter being to obtain intensive refining. Intensive refining effect is obtained, when the material to be refined moves more efficiently into the blade gap, while moving towards the discharge edge of the refining surface, due to the decreasing volume of the blade grooves. In the vicinity of the discharge edge of the refining surface the continuous densening of the blade grooves does no longer necessarily increase the refining effect, and consequently in the vicinity of the discharge edge the refining surface may have constant blade bar and blade groove density.

In refining surfaces without a special feed zone, the continuous densening of the blade bars 17 and/or the blade grooves 18 may also be arranged on the feed edge side portion of the refining surface, whereby fewer grooves will be formed on the feed edge side portion of the refining surface, which provides an efficient material feed effect on the feed edge side portion of the refining surface and a gradual decrease in the feed effect as the need for feeding decreases. In addition, the fewer grooves formed on the feed edge side portion of the refining surface enable sufficient hydraulic capacity on the refining surface portion that is often blocked when conventional solutions are used. Thanks to the continuous densening of the blade grooves, the hydraulic capacity of the blade grooves additionally decreases such that while proceeding towards the discharge edge the material to be refined moves more efficiently into the blade gap, whereby the refining effect of the refining surface will be enhanced.

Depending on the material to be refined, the continuous densening of the blade bars and/or the blade grooves may also be extended, however, throughout the whole area or length of the refining surface from the feed edge to the discharge edge of the refining surface.

The continuous densening of the blade bars 17 and/or the blade grooves 18 may thus be implemented only on a portion of the refining surface between the feed edge and the discharge edge thereof or throughout the whole refining surface between the feed edge and the discharge edge thereof. Preferably said densening is implemented on at least 30% portion of the refining surface between the feed edge and the discharge edge, more preferably on at least 50% portion of the refining surface.

The densening of the blade bars and/or the blade grooves of the refining surface may be implemented either in both opposite refining surfaces or in just one of the opposite refining surfaces, whereby the densening of the blade bars and/or blade grooves is preferably implemented in the rotor refining surface, which provides greater effect on material feed and formation of hydraulic capacity on the refining surface.

In some cases, the features disclosed in this application may be used as such, irrespective of other features. On the other hand, when necessary, the features disclosed in this application may be combined to provide different combinations.

The drawings and the related description are only intended to illustrate the idea of the invention. The details of the invention may vary within the scope of the claims. All the features presented in the figures and/or the description may be used both in disc refiners, cone refiners and in cylindrical refiners, and in blade elements applicable thereto. It is described above that the depth of all blade grooves changes in the run direction of the blade grooves, but it is also possible that the depth and/or width of just some of the blade grooves of the refining surface change in the run direction of the blade grooves. In that case, the blade grooves whose depth and/or width is arranged to change, are arranged in the opposite refining surfaces of the refiner such that said blade grooves encounter as the refining surfaces rotate in relation to one another.

Various embodiments and features of the refiner or its refining surface, or the blade element or its refining surface shown in FIGS. 5*a*, 5*b*, 5*c*, 6, 7, 8, 9, 10, 11, 12, 13, 14, 15*a*, 15*b*, 15*c*, 15*d*, 16, 17, 18, 19 and 20 may also be employed in refiners, blade elements or refining surfaces, where the blade bars 17 or the blade grooves 18 are not necessarily arranged at the blade angle of 40 to 80 degrees.

The invention claimed is:

1. A refiner for refining fibrous material comprising:

at least one first refining surface and at least one second refining surface, wherein the first refining surface and the second refining surface are arranged opposite to one another and rotatable in relation to one another in a rotational direction;

first refining surface portions at least on the first or the second refining surfaces for feeding the fibrous material to be refined or discharging the fibrous material after it has been refined, and on both the first refining surface and the second refining surface of said refiner second refining surface portions arranged to grind the fibrous material so forming refined fibrous material;

wherein the second refining surface portions have upper surfaces, the upper surfaces further comprising portions forming blade bars and between them blade grooves extending in a longitudinal direction;

wherein on both the first refining surface and the second refining surface of said refiner the blade grooves define cross-sectional areas, the cross-sectional areas of at least some blade grooves being arranged to change in a longitudinal direction of the blade grooves and at least on the first refining surface or the second refining surface of the refiner, the blade bars and the blade grooves are arranged at a blade angle of 40 to 80 degrees; and wherein the blade angle is defined between an imaginary radial line on the first refining surface and the second refining surface which is a projection of a radial axis defined by the rotational direction, onto the first refining surface and the second refining surface;

wherein the blade bars and the blade grooves are arranged to be curved so defining a radius of curvature of the blade bars which is 50 mm to 300 mm.

2. The refiner of claim 1 wherein in the first refining surface the blade grooves have a depth measured from the blade bars arranged to increase in the rotational direction and that in the second refining surface the blade grooves have a depth measured from the blade bars arranged to decrease in the rotational direction.

3. The refiner of claim 1 wherein in the first refining surface the blade grooves have a depth measured from the blade bars arranged to increase in the rotational direction and that in the second refining surface the blade grooves have a depth measured from the blade bars arranged to increase in the rotational direction.

4. The refiner of claim 1 wherein at least some of the blade grooves are arranged connected to the first refining surface portions to feed the fibrous material or to discharge the refined fibrous material.

5. The refiner of claim 4 wherein the second refining surface portions are arranged consecutively in the rotational direction, and are located between the first refining surface portions;

wherein the blade grooves have a depth measured from the blade bars, the depth being arranged to increase in every other grinding refining surface portion and to decrease in every other grinding refining surface portion.

6. The refiner of claim 1 wherein the first refining surface portions feeding the material to be refined or discharging the refined material are arranged substantially in a radial direction defined transverse to the rotational direction of the refining surfaces.

7. The refiner of claim 1 wherein the blade grooves have a depth measured from the blade bars, and wherein the depth of the blade grooves is arranged to change so that the blade grooves have convex and concave portions.

8. The refiner of claim 1 wherein in the first refining surface 60 to 90% of the blade grooves have a cross-sectional area increasing in the rotational direction and 10 to 40% of the blade grooves have a cross-sectional area decreasing in the rotational direction; and wherein in the second refining surface 80 to 100% of the blade grooves have a cross-sectional area decreasing in the rotational direction and 0 to 20% of the blade grooves have a cross-sectional area increasing in the rotational direction.

9. The refiner of claim 1 wherein in the first refining surface 40 to 80% of the blade grooves have a cross-sectional area increasing in the rotational direction, and 20 to 60% of the blade grooves have a cross-sectional area decreasing in the rotational direction; and wherein in the second refining surface 40 to 80% of the blade grooves have a cross-sectional area decreasing in the rotational direction and 20 to 60% of the blade grooves comprise a cross-sectional area increasing in the rotational direction.

10. The refiner of claim 1 wherein the at least one first refining surface or the at least one second refining surface has at least some blade grooves with a cross-sectional area which increase from one blade groove to a next in the rotational direction.

11. A blade element in a refiner for refining fibrous material, the blade element comprising:

a refining surface on the blade element, the blade element having an imaginary radial line of the refining surface such that when the blade element is mounted for rotation in the refiner, said rotation defines a radial axis, and said imaginary radial line is a projection of the radial axis on to the blade element;

the refining surface having portions arranged to grind the fibrous material so forming refined fibrous material, wherein the refining surface portions have upper surfaces, the upper surfaces further comprising portions forming blade bars and between them blade grooves extending in a longitudinal direction, the blade grooves having a cross-sectional area; and wherein the cross-sectional area of at least some of the blade grooves changes in the longitudinal direction and wherein the blade bars and the blade grooves are arranged at a blade angle of 40 to 80 degrees to the imaginary radial line;

wherein the width of the blade bars is 0.5 to 5 mm and the width of the blade grooves is 0.5 to 5 mm.

12. The blade element of claim 11 wherein the blade element further comprises refining surface portions feeding the fibrous material and refining surface portions discharging the refined fibrous material, between which are the refining surface portions grinding the fibrous material, and that at least some of the blade grooves on the upper surface of the refining surface portions grinding the fibrous material are arranged connected to the refining surface portions feeding the fibrous material or discharging the refined fibrous material.

13. The blade element of claim 11 wherein the blade grooves have a depth measured from the blade bars, and wherein the depth is arranged to increase in every other grinding refining surface portion and to decrease in every other grinding refining surface portion.

14. The blade element of claim 11 wherein the first refining surface portions feeding the fibrous material or discharging the refined material are arranged substantially in a radial direction defined by the imaginary line on the refining surface.

15. The refiner of claim 11 wherein the blade bars and the blade grooves are arranged to be curved so defining a radius of curvature of the blade bars which is 50 mm to 300 mm.

16. The refiner of claim 11 wherein the blade grooves have a depth measured from the blade bars and wherein the depth of the blade grooves is arranged to change so that the blade grooves have convex and concave portions.

17. The blade element of claim 11 wherein the blade grooves define a blade groove cross-sectional area; and wherein the cross-sectional area of at least some blade grooves is arranged to increase from one blade groove to the next along the imaginary radial line in a direction away from the axis defined by the rotation.

18. A blade element in a refiner for refining fibrous material, the blade element comprising:

a refining surface on the blade element, the blade element having an imaginary radial line of the refining surface such that when the blade element is mounted for rotation in the refiner, said rotation defines a radial axis, and said imaginary radial line is a projection of the radial axis on to the blade element;

the refining surface having portions arranged to grind the fibrous material so forming refined fibrous material, wherein the refining surface portions have upper surfaces, the upper surfaces further comprising portions forming blade bars and between them blade grooves extending in a longitudinal direction, the blade grooves having a cross-sectional area;

wherein the cross-sectional area of at least some of the blade grooves changes in the longitudinal direction and wherein the blade bars and the blade grooves are arranged at a blade angle of 40 to 80 degrees to the imaginary radial line;

wherein the blade grooves define a blade groove cross-sectional area; and wherein the cross-sectional area of at least some blade grooves is arranged to decrease from one blade groove to the next along the imaginary radial line in a direction away from the axis defined by the rotation.

* * * * *